US012054326B2

(12) United States Patent
Patel

(10) Patent No.: US 12,054,326 B2
(45) Date of Patent: Aug. 6, 2024

(54) REMOVABLE CONTAINER LIDS AND CONTAINER ASSEMBLIES CONTAINING SAME

(71) Applicant: Shamir Patel, Windermere, FL (US)

(72) Inventor: Shamir Patel, Windermere, FL (US)

( * ) Notice: Subject to any disclaimer, the term of this patent is extended or adjusted under 35 U.S.C. 154(b) by 0 days.

(21) Appl. No.: 18/050,726

(22) Filed: Oct. 28, 2022

(65) Prior Publication Data

US 2024/0124202 A1 Apr. 18, 2024

Related U.S. Application Data

(60) Provisional application No. 63/379,932, filed on Oct. 18, 2022.

(51) Int. Cl.
*B65D 51/28* (2006.01)
*B65D 41/04* (2006.01)
*B65D 47/06* (2006.01)

(52) U.S. Cl.
CPC ..... *B65D 51/2807* (2013.01); *B65D 41/04* (2013.01); *B65D 47/06* (2013.01)

(58) Field of Classification Search
CPC ..... B65D 51/2807; B65D 47/06
See application file for complete search history.

(56) References Cited

U.S. PATENT DOCUMENTS

| | | | | |
|---|---|---|---|---|
| 7,198,168 | B2 * | 4/2007 | Mizuma | B65D 17/4014 220/730 |
| 8,083,055 | B2 * | 12/2011 | Simonian | B65D 47/243 222/145.5 |
| 8,172,079 | B2 * | 5/2012 | Greenberg | B65D 81/3211 206/219 |
| 8,365,960 | B1 * | 2/2013 | Kalaouze | B65D 81/3211 206/229 |
| 11,345,535 | B2 * | 5/2022 | Staus | B01F 33/50111 |
| 2006/0251771 | A1 | 11/2006 | Yokota | |
| 2020/0114321 | A1 | 4/2020 | Bertsch | |
| 2020/0214326 | A1 | 7/2020 | Akhumyan et al. | |
| 2022/0024673 | A1 | 1/2022 | Silver | |

FOREIGN PATENT DOCUMENTS

| | | | | |
|---|---|---|---|---|
| KR | 2012019190 A | * | 3/2012 | B65D 51/2807 |

OTHER PUBLICATIONS

English translation of KR 20120019190. (Year: 2023).*

* cited by examiner

*Primary Examiner* — James N Smalley
(74) *Attorney, Agent, or Firm* — Fox Rothschild LLP

(57) ABSTRACT

This disclosure provides a novel container lid and a container assembly comprising a beverage or food container and a container lid. The disclosed container lid or container assembly allows the substance in the container lid to be mixed with beverage or food contained in the beverage or food container conveniently and effectively. In addition, the container lid can have a shape adapted for easy stacking in boxes for shipping and on shelves for display to a consumer.

28 Claims, 34 Drawing Sheets

REMOVABLE CONTAINER LIDS AND CONTAINER ASSEMBLIES CONTAINING SAME

CROSS-REFERENCE TO RELATED APPLICATIONS

This application claims priority under 35 U.S.C. § 119(e) to U.S. Provisional Patent Application No. 63/379,932, filed Oct. 18, 2022. The foregoing application is incorporated by reference herein in its entirety.

FIELD OF THE INVENTION

This disclosure relates to a removable container lid and a container assembly containing same.

BACKGROUND OF THE INVENTION

Fruit juice contains vitamins, minerals, and beneficial compounds that sugary soda typically lacks. Against popular belief, a half cup of fruit juice is just as rich in most vitamins and minerals, including iron, potassium, magnesium, and B vitamins, as the same quantity of fresh fruit. Studies show drinking no more than five ounces a day is linked to a lower risk of heart disease and stroke. Currently, fruit drinks are generally provided in cans or other beverage containers. Maintaining fruit drinks in a shelf-stable state is challenging and often requires additional ingredients, such as additives, to stabilize fruit drinks. As a result, consumers have to consume ingredients in drinks used to stabilize ingredients or added to increase shelf life that are essentially harmful to them or may otherwise compromise the benefits of fruit juice.

Thus, there is a need for novel container assemblies for serving fruit juice.

SUMMARY OF THE INVENTION

This disclosure addresses the need mentioned above in a number of aspects. In one aspect, this disclosure provides a container assembly, comprising: a beverage or food container and a container lid, comprising a top portion, a base portion, and a wall connecting the top portion and the base portion, wherein the container lid comprises a coupling structure adapted to be removably mounted to the beverage or food container, thereby coupling the container lid to a least a portion of the beverage or food container, wherein the top portion, the base portion, and the wall define a compartment adapted to enclose a substance, and wherein the container lid further comprises a sealable opening, through which the substance is to be unloaded from the container lid and mixed with beverage or food contained within the beverage or food container.

In some embodiments, the beverage or food container is a beverage container. In some embodiments, the container lid contains the substance. In some embodiments, the substance comprises fruit powder.

In some embodiments, the coupling structure is positioned outwardly away from the top portion and the base portion of the container lid. In some embodiments, the coupling structure is positioned below the base portion of the container lid. In some embodiments, the coupling to structure is positioned above the top portion of the container lid. In some embodiments, the coupling structure is positioned inwardly towards the top portion of the container lid.

In some embodiments, the coupling structure extends from the base portion or the wall of the container lid and is adapted to engage an outer surface of the beverage or food container.

In some embodiments, the coupling structure encircles the base portion. In some embodiments, the coupling structure protrudes from a bottom edge of the wall of the container lid.

In some embodiments, the coupling structure has a smaller or larger circumference than the base portion. In some embodiments, the coupling structure has the same circumference as the base portion.

In some embodiments, the container lid comprises an inner wall extending upwardly from the base portion, and wherein the inner wall forms a least a portion of the coupling structure. In some embodiments, the coupling structure comprises screw thread adapted to secure the container lid to the beverage or food container.

In some embodiments, the container lid comprises a spout protruding downwardly from the base portion, the spout adapted to aid in unloading and mixing of the substance with the beverage or food contained within the beverage or food container. In some embodiments, the spout has an upper portion connecting with a least a portion of the wall or the base portion of the container lid, and a lower portion in contact with an outer surface of the beverage or food container. In some embodiments, a least a portion of the spout and the opening are positioned on the same plane.

In some embodiments, the top portion has a circumference larger or smaller than the base portion. In some embodiments, the top portion has a cone, sphere, cube, squircle, or round shape. In some embodiments, the top portion or the base portion has a circular, oval, ellipse, triangular, square, rectangular, or polygonal cross-sectional shape.

In some embodiments, the top portion comprises a surface having a shape adapted to complement a bottom surface of the beverage or food container, such that the container assembly is stackable above or below a second container assembly.

In some embodiments, the opening is positioned at the base portion. In some embodiments, the opening is positioned at the top portion. In some embodiments, the container lid comprises a cover adapted to seal the opening. In some embodiments, the opening is resealable with the cover.

In some embodiments, the container lid or the beverage or food container is formed of a transparent material. In some embodiments, the container lid comprises a thermoplastic material.

In some embodiments, the beverage or food container further comprises a cover adapted to cover the beverage or food container. In some embodiments, the beverage or food container is resealable with the cover. In some embodiments, the beverage or food container is a can or a bottle.

In another aspect, this disclosure also provides a method of providing a beverage. In some embodiments, the method comprises: providing container assembly described herein; removing the container lid away by disengaging from the beverage or food container; unloading the fruit powder from the container lid through the opening; and mixing the fruit powder with the beverage or food contained within the beverage or food container.

The foregoing summary is not intended to define every aspect of the disclosure, and additional aspects are described in other sections, such as the following detailed description. The entire document is intended to be related as a unified disclosure, and it should be understood that all combinations of features described herein are contemplated, even if the combinations of features are not found together in the same sentence, or paragraph, or section of this document. Other features and advantages of the invention will become apparent from the following detailed description. It should be understood, however, that the detailed description and the specific examples, while indicating specific embodiments of the disclosure, are given by way of illustration only, because various changes and modifications within the spirit and scope of the disclosure will become apparent to those skilled in the art from this detailed description.

DETAILED DESCRIPTION OF THE INVENTION

Figure 1:
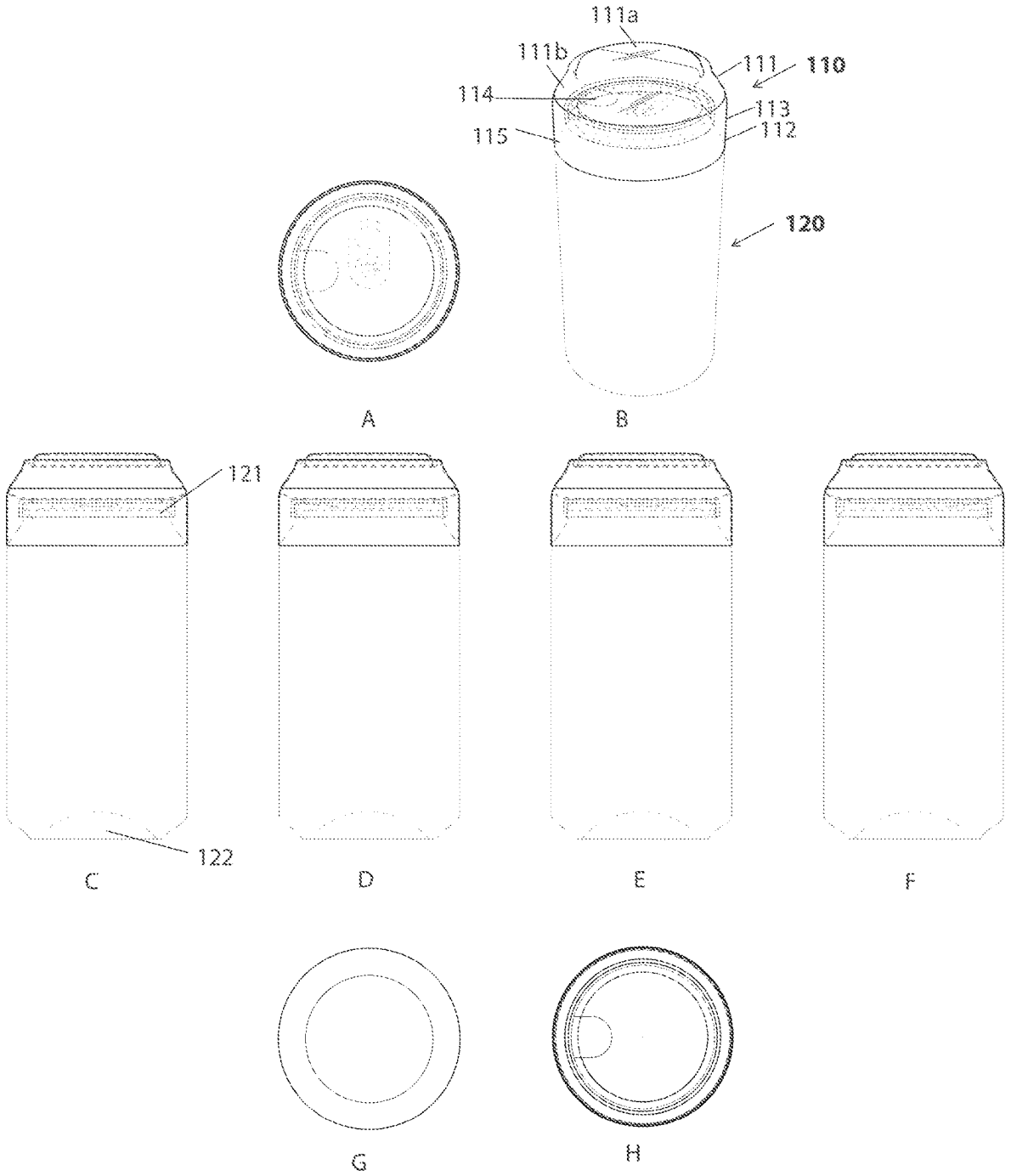
FIGS. 1A, 1B, 1C, 1D, 1E, 1F, 1G, and 1H (collectively "FIG. 1") shows an example container assembly having a beverage can and container lid.
Figure 2:
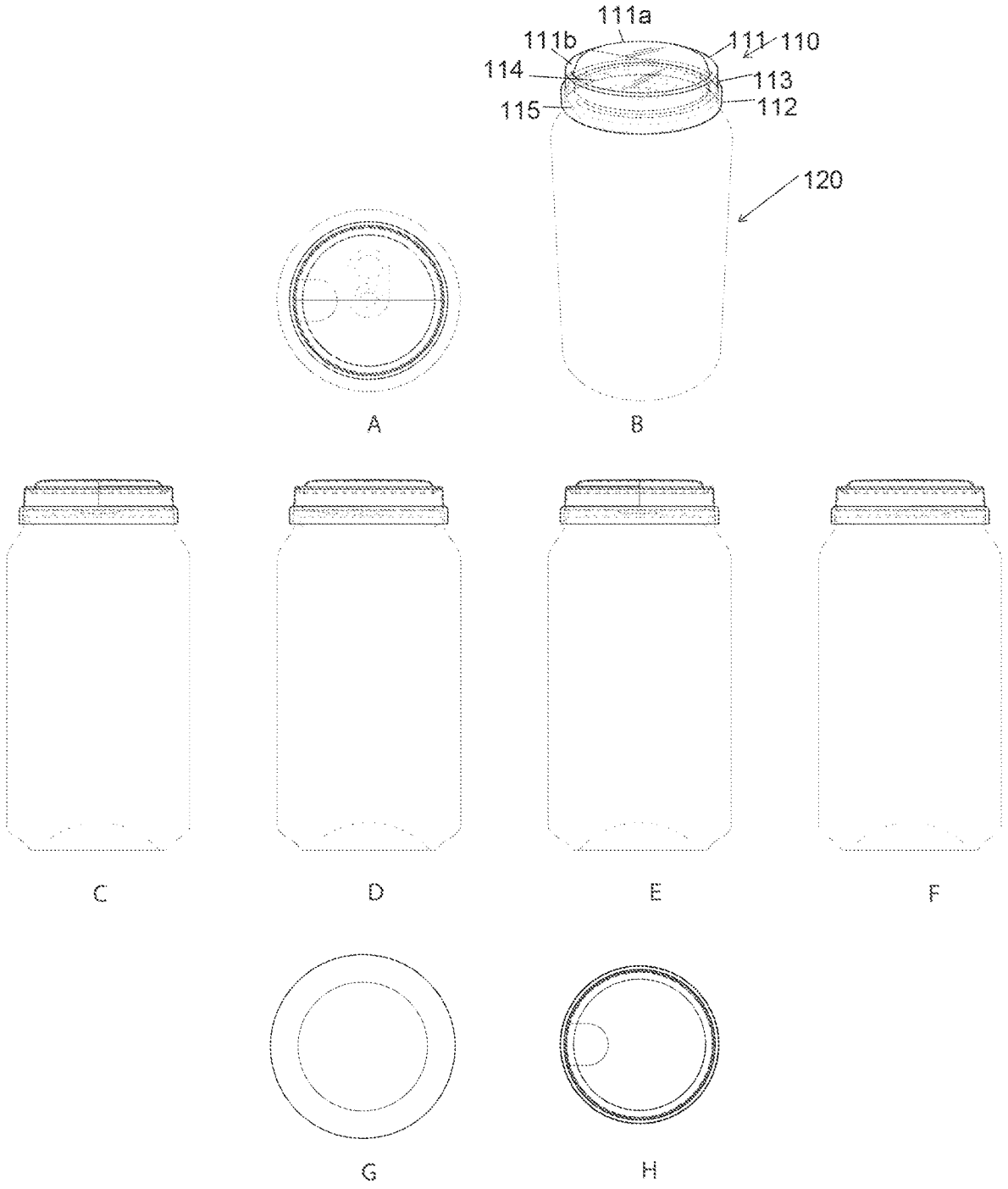
FIGS. 2A, 2B, 2C, 2D, 2E, 2F, 2G, and 2H (collectively "FIG. 2") shows an example container assembly having a beverage can and container lid.
Figure 3:
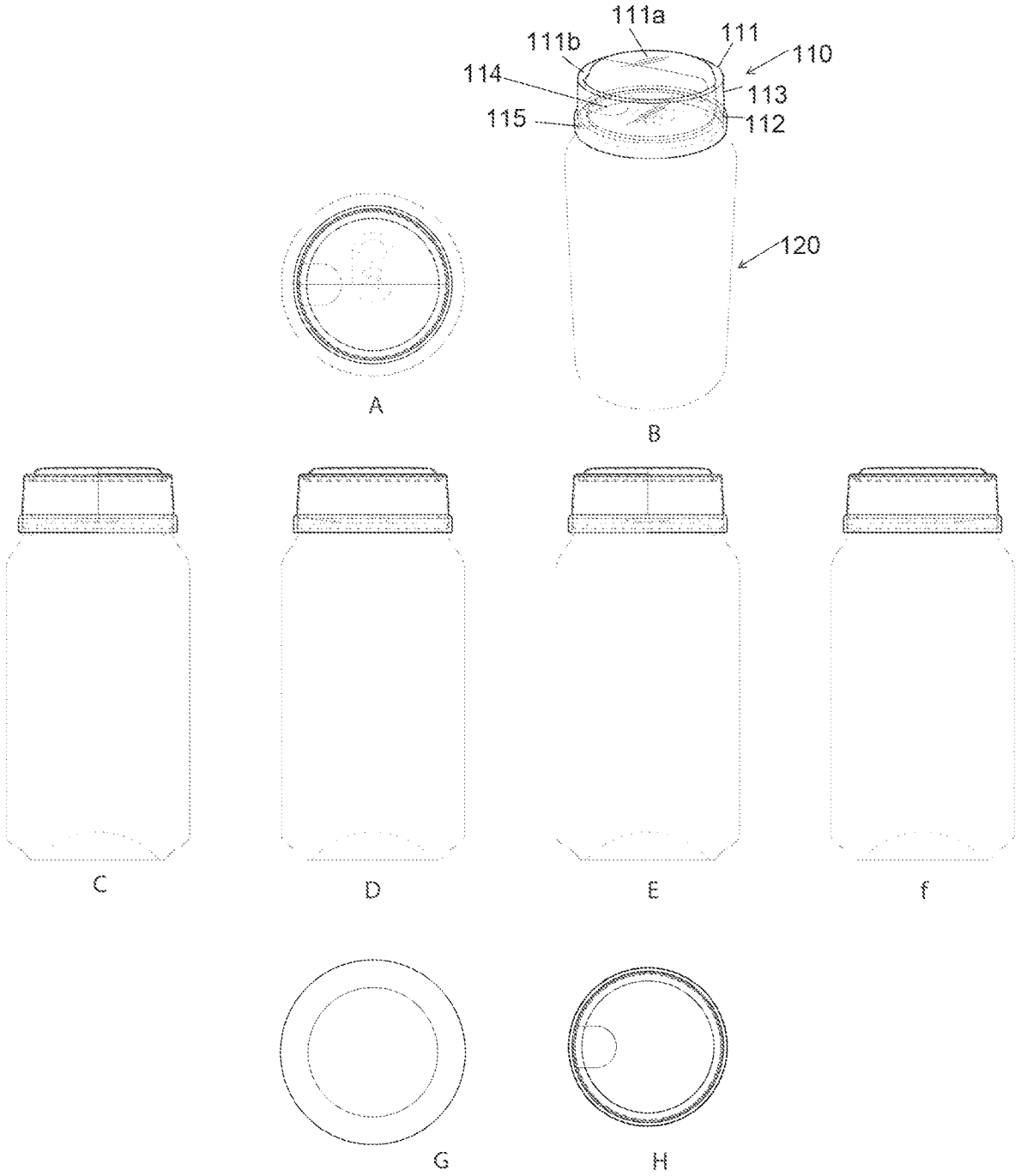
FIGS. 3A, 3B, 3C, 3D, 3E, 3F, 3G, and 3H (collectively "FIG. 3") shows an example container assembly having a beverage can and container lid.
Figure 4:
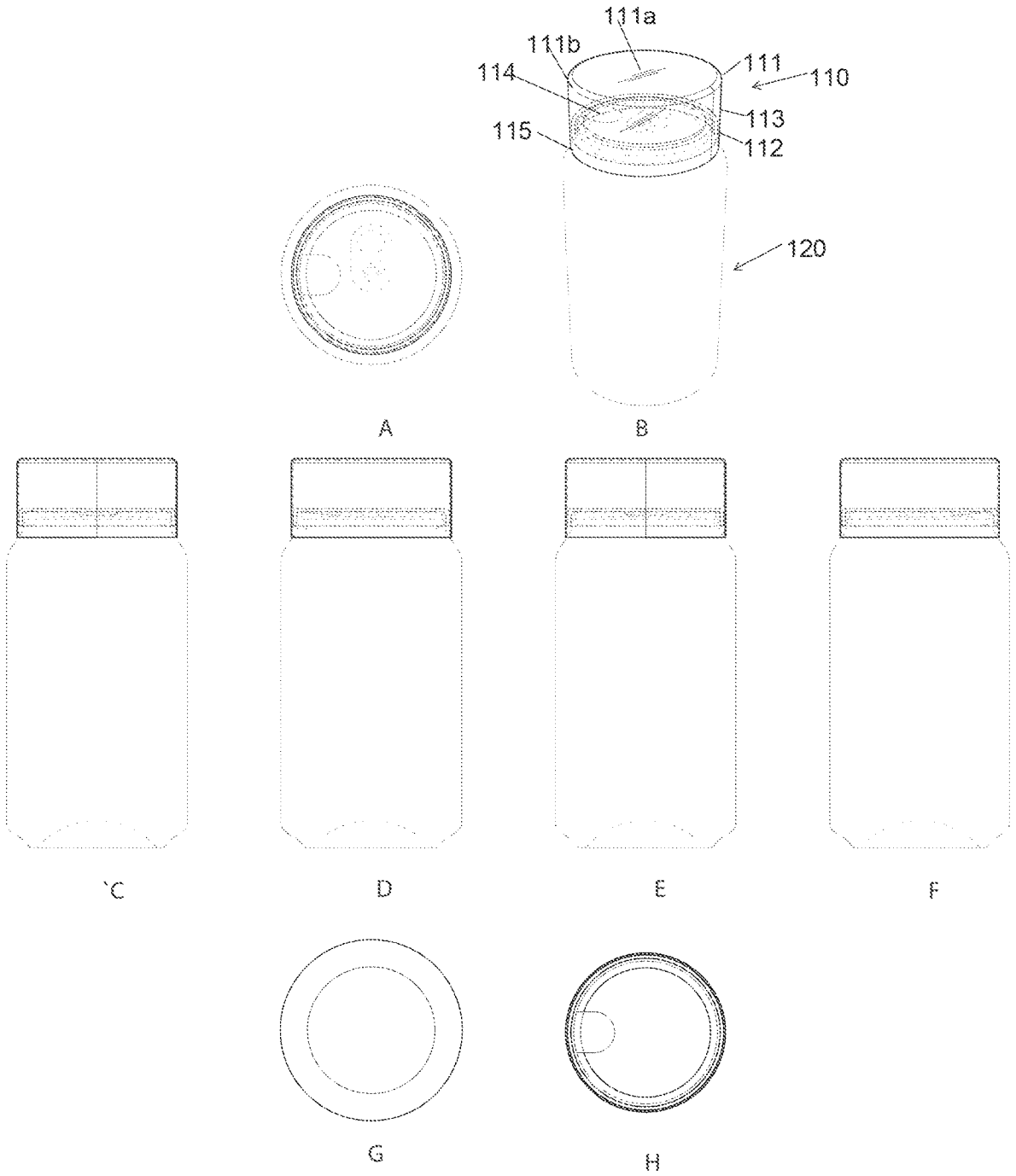
FIGS. 4A, 4B, 4C, 4D, 4E, 4F, 4G, and 4H (collectively "FIG. 4") shows an example container assembly having a beverage can and container lid.
Figure 5:
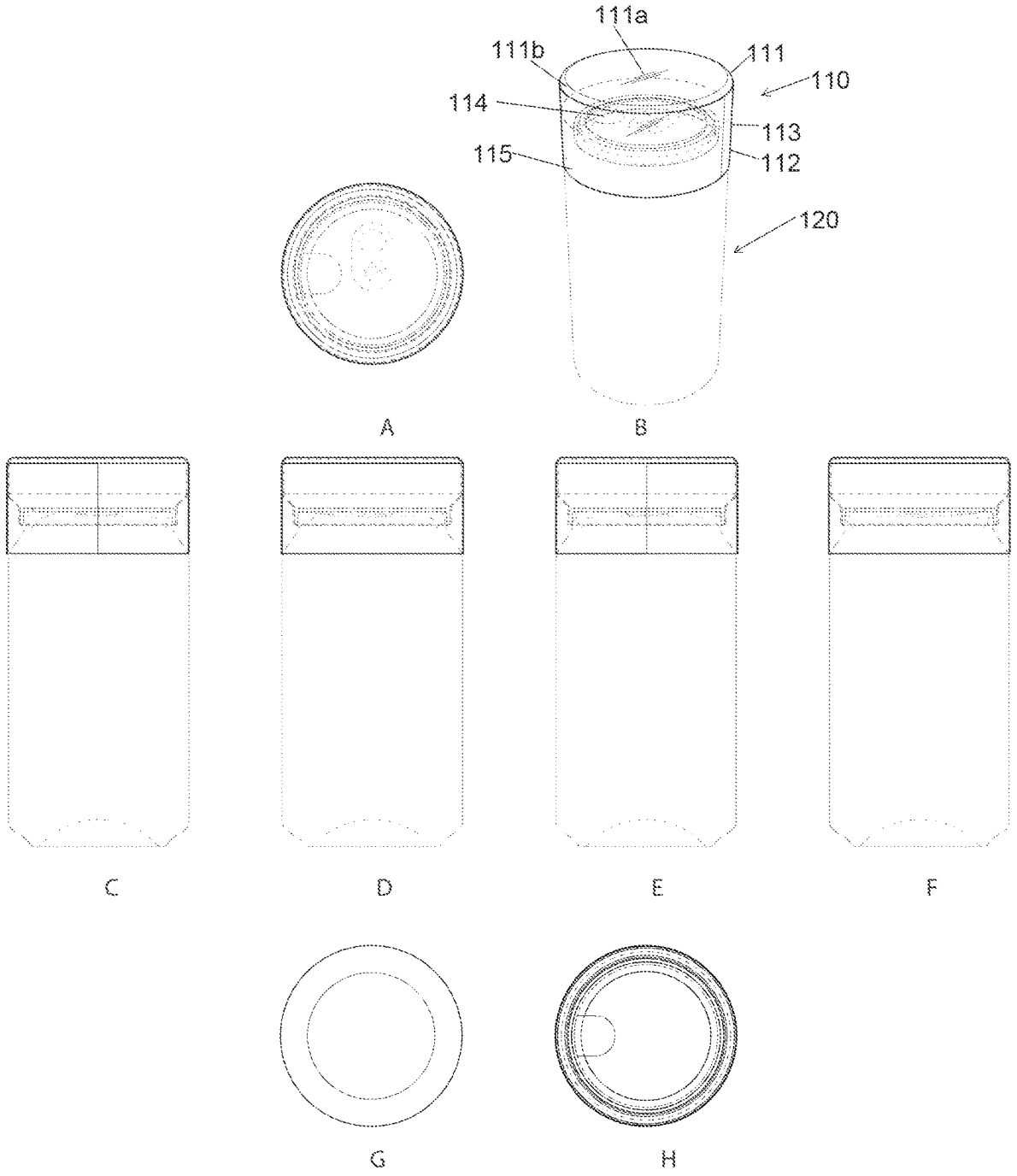
FIGS. 5A, 5B, 5C, 5D, 5E, 5F, 5G, and 5H (collectively "FIG. 5") shows an example container assembly having a beverage can and container lid.
Figure 6:
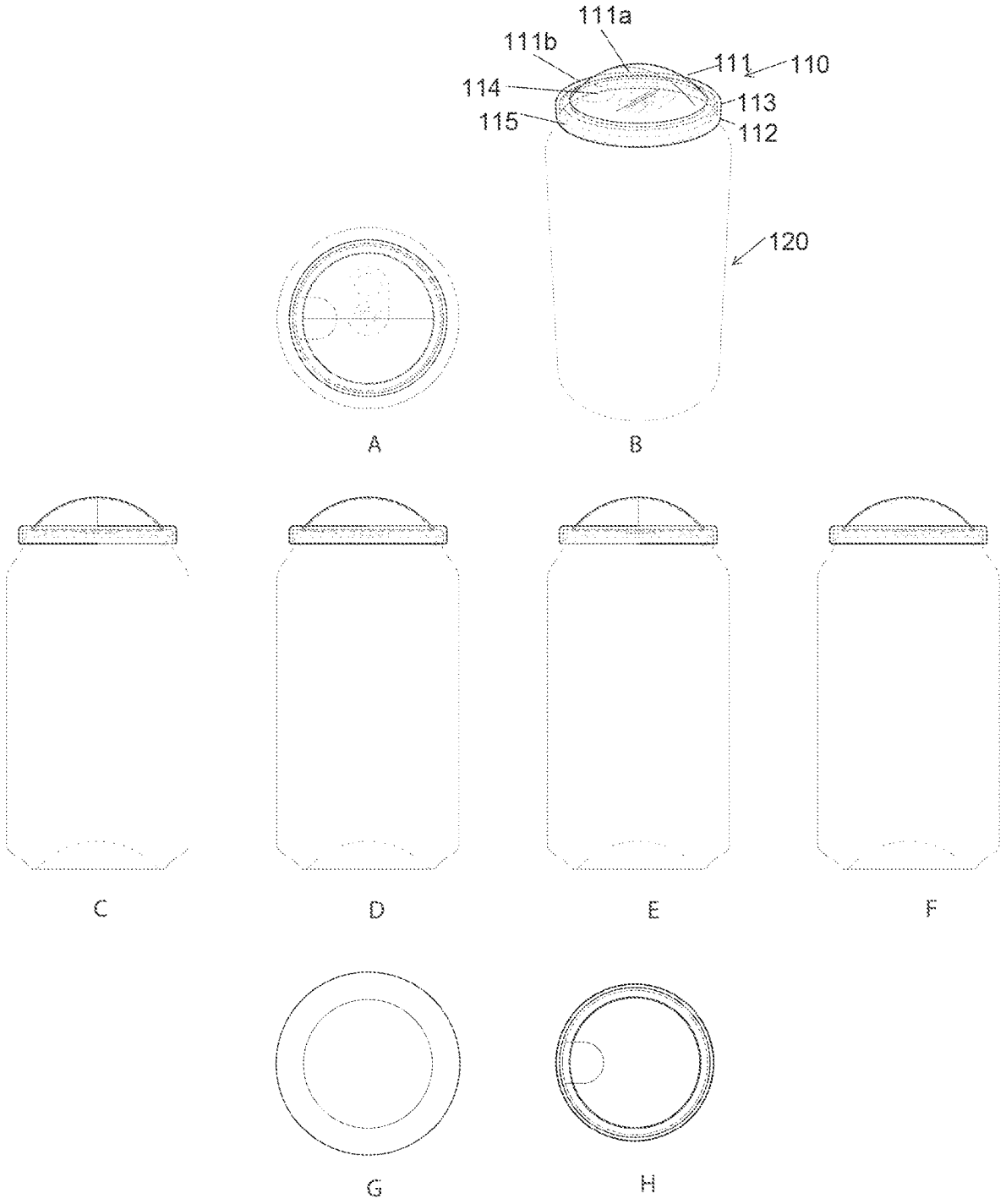
FIGS. 6A, 6B, 6C, 6D, 6E, 6F, 6G, and 6H (collectively "FIG. 6") shows an example container assembly having a beverage can and container lid.
Figure 7:
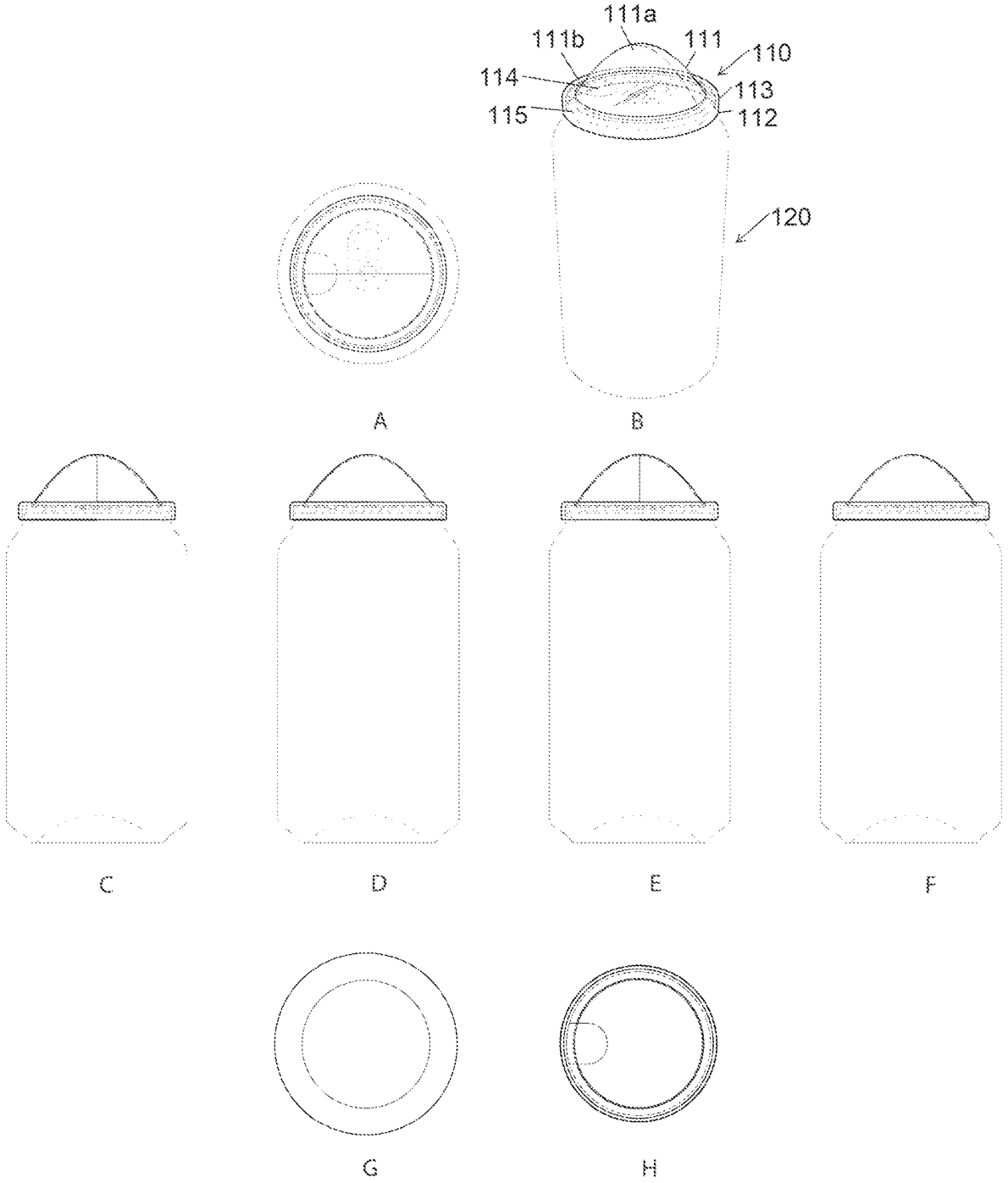
FIGS. 7A, 7B, 7C, 7D, 7E, 7F, 7G, and 7H (collectively "FIG. 7") shows an example container assembly having a beverage can and container lid.
Figure 8:
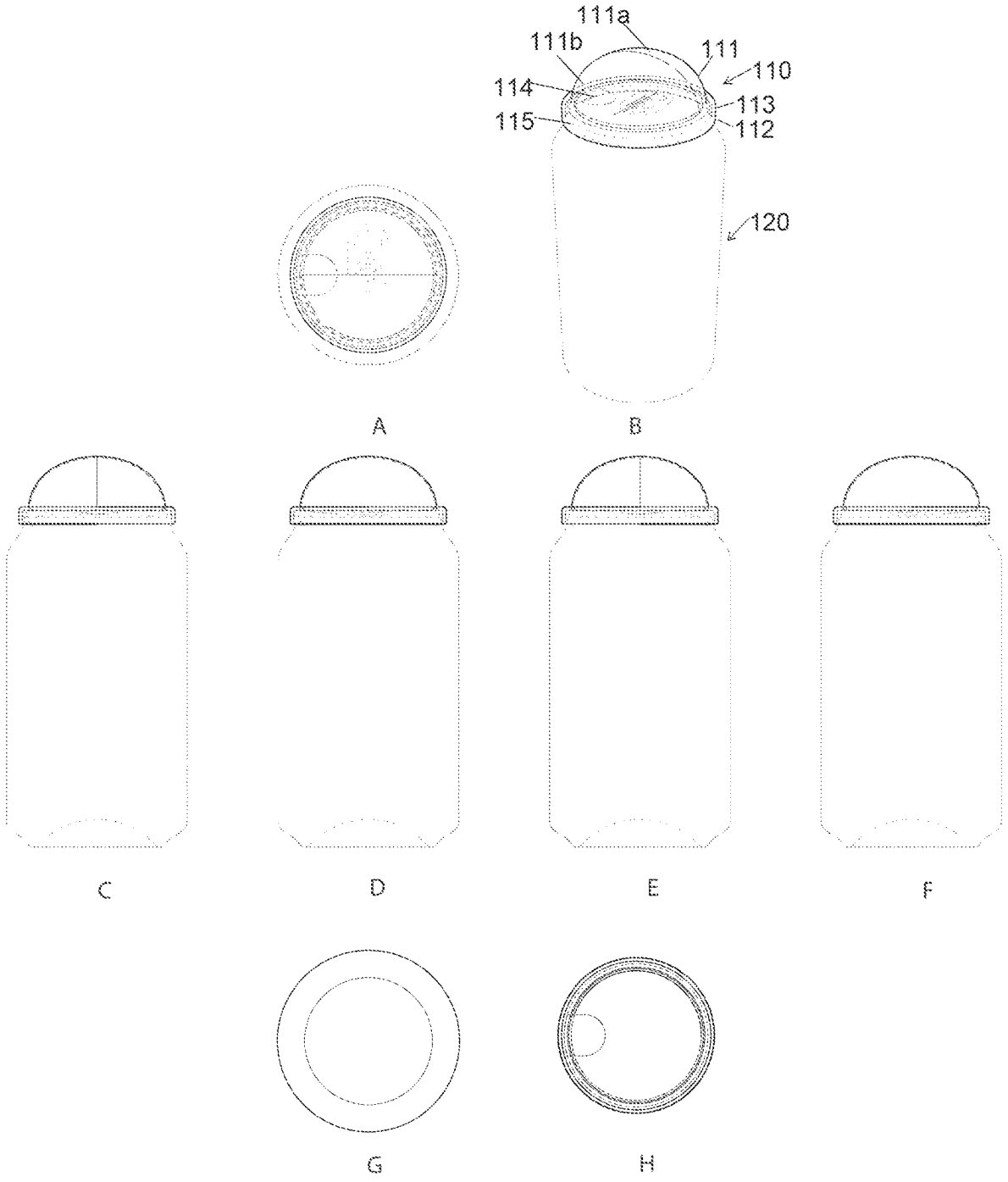
FIGS. 8A, 8B, 8C, 8D, 8E, 8F, 8G, and 8H (collectively "FIG. 8") shows an example container assembly having a beverage can and container lid.
Figure 9:
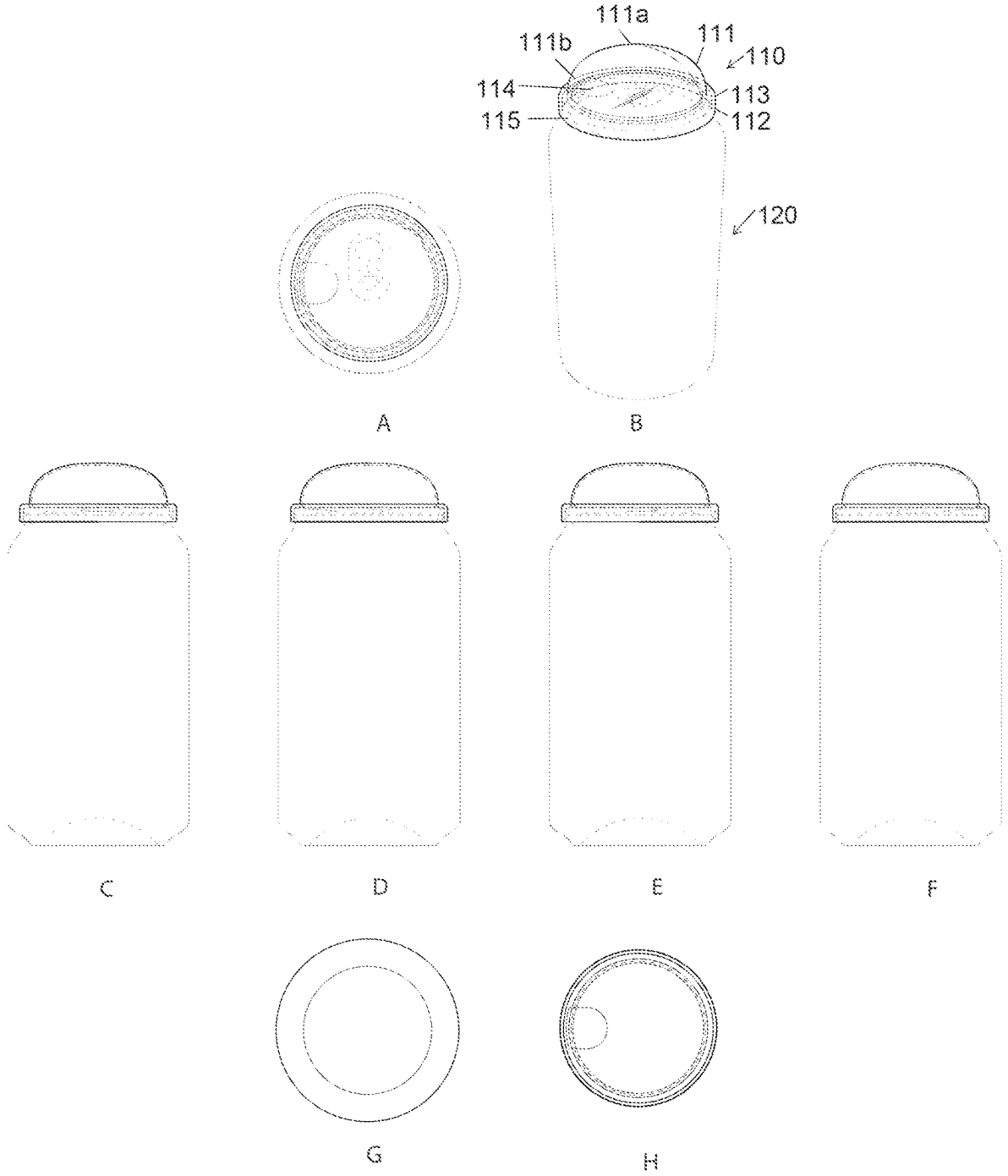
FIGS. 9A, 9B, 9C, 9D, 9E, 9F, 9G, and 9H (collectively "FIG. 9") shows an example container assembly having a beverage can and container lid containing a spout.

This disclosure provides a novel container lid and a container assembly comprising a beverage or food container and a container lid. The disclosed container lid or container assembly allows the substance in the container lid to be mixed with beverage or food contained in the beverage or food container conveniently and effectively. In addition, the container lid can have a shape adapted for easy stacking in boxes for shipping and on shelves for display to a consumer. The disclosed container lid has a compact design that snaps into any can or bottle, providing a cleaner, healthier, tastier, and non-placebo branding in a highly convenient mixed drink for the modern consumer.

In some embodiments, the container lid may include a top portion, a base portion, and a wall connecting the top portion and the base portion. In some embodiments, the container lid may include a coupling structure adapted to be removably mounted to the beverage or food container, thereby coupling the container lid to a least a portion of the beverage or food container. In some embodiments, the top portion, the base portion, and the wall define a compartment adapted to enclose a substance. In some embodiments, the container lid further may include a sealable opening, through which the substance is to be unloaded from the container lid and mixed with beverage or food contained within the beverage or food container.

Referring now to FIGS. 1-9, an example container assembly according to various embodiments of this disclosure is provided. In some embodiments, the container assembly may include a container lid 110 and a beverage or food container 120.

In some embodiments, the container lid 110 may be removably mounted to the beverage or food container 120 by any suitable means, including but not limited to, complementary threading, snap-fit or friction-fit means, bayonet means, or any other suitable mechanism or combination of mechanisms for coupling, as will be appreciated by those skilled in the art. In some embodiments, the container lid 110 can be easily removed by one hand as the other hand holds the beverage or food container 120.

As used herein, the term "container" refers to an article that is capable of holding a material, such as a fluent material, and includes, but is not limited to bottles, unit dose pods, pouches, sachets, boxes, packages, cans, and cartons. The containers can have a rigid, flexi-resilient, or flexible structure in whole or in part.

In some embodiments, the beverage or food container 120 may be a can, a bottle, or any other packaging. In some embodiments, the beverage or food container 120 may include a can, bottle, cup, pouch, box, carton, bag, blister pack, or combinations thereof. In some embodiments, the beverage or food container 120 can be a metal bottle, a polyethylene terephthalate (PET) bottle container, an aluminum can or a steel can, or a resin container such as a pouch container.

In some embodiments, the beverage or food container 120 further may include a cover or cap adapted to cover the beverage or food container 120. In some embodiments, the cover or cap may be disposed on the top of the container. In some embodiments, the cover may include aluminum foil, a thermoplastic film, or other water-resistant or moisture-proof material.

In some embodiments, the beverage or food container 120 may be resealable or reclosable with the cover or cap. In some embodiments, the cover or cap may be a resealable cover. In some embodiments, a resealable cover or cap may be a screw-on cap, a flip-top cap, or other types of removable closures. As used herein, the term "resealable" refers to a closure that can be closed at least once after the beverage or food container 120 is opened for the first time. In some embodiments, the closure can be opened and closed additional times after the initial opening to remove all of the contents.

In some embodiments, the beverage or food container 120 can be of any shape or size. For example, the container may have a cylindrical shape, a cubic shape, a conical or frustoconical shape, a partially spherical shape, a tetrahedral shape, or others. In some embodiments, the beverage or food container 120 may have a substantially cylindrical shape.

In some embodiments, the beverage or food container 120 may be a container for any fluid drink, such as a beverage container. For example, the beverage or food container may be a container of any fluent product or beverage type, such as a can of a soft drink (e.g., carbonated or uncarbonated drinks, such as beer, lite beer, red wine, white wine, milk, soda, diet soda, water, coconut water, energy drink, orange juice, etc.).

In some embodiments, the container lid 110 may include a top portion 111, a base portion 112, and a wall 113 connecting the top portion 111 and the base portion 112. In some embodiments, the top portion 111 has a cone, sphere, cube, squircle, or round shape. In some embodiments, the top portion 111 or the base portion 112 may have a circular, oval, ellipse, triangular, square, rectangular, or polygonal cross-sectional shape.

In some embodiments, the container lid 110 may have a cross-section having a circular, oval, ellipse, triangular, square, rectangular, or polygonal shape. For example, the container lid 110 may have a substantially cylindrical shape, a cone shape, a capsule shape, a bubble shape, a swell shape, a can shape, a cap shape, a cube shape, a round shape, a sphere shape, a squircle shape, or any other suitable shape.

In some embodiments, the top portion 111 may have a larger or smaller circumference than the base portion 112. In some embodiments, the top portion 111 may have the same circumference as the base portion 112.

In some embodiments, the top portion 111, the base portion 112, and the wall 113 define a compartment adapted to enclose a substance. As used herein, the term "compartment" refers to a part or a space designated, defined, marked or partitioned off from a structure.

In some embodiments, the container lid 110 may contain the substance. In some embodiments, the substance may include dry fruit, such as fruit in the form of a dry fruit powder mix. In some embodiments, the dry fruit, e.g., dry fruit powder mix, may be mixed with a beverage contained in the beverage or food container 120 to prepare a fruit juice.

As used herein, the term "fruit juice" refers to any fruit flavored liquid whether natural, synthetic, or combination thereof. Examples of suitable fruit sources typically include fruit juice, juice concentrates, fruit puree and blends thereof including apple, apricot, banana, bilberry, blackberry, blueberry, boysenberry, melon, cherry, cranapple, cranberry, currant, elderberry, grape, grapefruit, honeydew, huckleberry, kiwi, lemon, lime, mango, nectarine, orange, papaya, passion fruit, peach, pineapple, plum, pomegranate, prune, raspberry, strawberry, tangerine, tomato, and watermelon. Fruit juices can refer to liquids that are artificially flavored to provide fruit-like taste.

As will be understood by a person skilled in the art, the container lid 110 may contain any other suitable substance, including without limitation, edible fiber, yogurt, carbohydrates, fats, proteins, antioxidants, electrolytes, vitamins, minerals, enzymes, coenzymes, botanicals, herbs, spices, anthocyanins, anthocyanidins, beta-carotene, bioflavonoids, catechins, carotenoids, curcuma, dandelion root, epicatechins, flavones, flavonoids, flavonols, tea, tea polyphenols, garlic, *Ginkgo biloba*, grape seed, grape skin, green tea, epigallocatechin-3-O-gallate, indoles, isocyanates, isoflavones, isoflavonoids, isoprenoids, lycopene, organosulfur compounds, phenols, phenolic acids, polyphenolic compounds, pycnogenols, resveratrol, silymarin, terpenes, tannins, thiols, and tocopherols (beta, gamma, and delta), alpha-lipoic acid, coenzyme Q10, and n-acetyl-1-cysteine, organoleptic agents, coloring agents, preservatives, flavoring agents, sweeteners, stimulants, L-carnitine, L-ornithine, L-tyrosine, L-tryptophan, L-phenylalanine, gamma-linolenic acid, chromium, glucose tolerance factor, vanadyl sulfate, *Gymnema sylvestere*, bromelain, pancreatin, papain, curcumin, barberry, bearberry, *Teucrium polium*, choline, inositol, human growth hormone, DHEA (dehydroepiandosterone), caffeine; xanthines, kola nut, yerbamate, medium chain triglycerides, (–)-hydroxycitric Acid (HCA), kelp, lecithin, dihydroxyacetone, pyruvate, creatine, iodine, bladderwrack, hoodia, glutathione peroxidase, superoxide disumutase, lipotropics, charcoal, phosphatidyl choline, methionine, tumeric, wall germander, Oregon grape root, pomegranate, ellagic acid, ellagitannins, Acia, flaxseed, guar, psyllium, acacia, konjac, vanilla, chocolate, cocoa, locust bean gum, oat, cinnamon, nut, fruit, fruit juice, egg, wheat germ, beef bullion cube, chicken bullion cube, pork bullion cube, baby food, cheese, whey, cornmeal and honey.

In some embodiments, the container lid 110 may further include at least one sealable opening 114. In some embodiments, the container lid 110 may include at least one resealable or reclosable opening 114. In some embodiments, the opening 114 may be sealed or closed by a cover or a cap. In some embodiments, the cover or cap may be removably disposed on an outer surface of the opening 114. In some embodiments, the cover or cap may include aluminum foil, a thermoplastic film, or other water-resistant or moisture-proof material. In some embodiments, the cover or cap may be attached to the opening 114 by any suitable means, including but not limited to, complementary threading, snap-fit or friction-fit means, bayonet means, or any other suitable mechanism or combination of mechanisms for coupling, as will be appreciated by those skilled *in* the art. In some embodiments, the cover or cap may include adhesive, such as pressure-sensitive adhesive, such that the cover or cap may be adhesively joined to and seal the opening 114.

In some embodiments, the cover or cap for the opening 114 may be attached to the base portion 112 through a hinge. In some embodiments, the hinge connects the base portion 112 of the container lid 110 and the cover or cap. In some embodiments, the hinge is coupled with the base portion 112 of the container lid 110 and configure to enclose the opening 114 of the container lid 110 by the cover or cap. For example, the cover or cap may be a flip-type lid secured to the container lid 110 through the hinge.

In some embodiments, the opening 114 may have any suitable shapes, such as a circular, oval, ellipse, triangular, square, rectangular, or polygonal shape. For example, the opening 114 may have any cross-sectional shapes, such as a circular, oval, ellipse, triangular, square, rectangular, or polygonal shape.

In some embodiments, the opening 114 may be used to introduce or unload a liquid or solid substance as described above. In some embodiments, the substance may be unloaded through the opening 114 from the container lid 110 and mixed with beverage or food contained within the beverage or food container 120.

In some embodiments, the opening 114 is positioned at the base portion 112. In some embodiments, the opening 114 is positioned at the top portion 111.

In some embodiments, the container lid 110 may include a coupling structure 115 adapted to be removably mounted to the beverage or food container 120, thereby coupling the container lid 110 to a least a portion of the beverage or food container 120.

In some embodiments, the coupling structure 115 may removably engage with at least a portion (e.g., mouth 121) of the beverage or food container 120 by any suitable means, including but not limited to, complementary threading, snap-fit or friction-fit means, bayonet means, or any other suitable mechanism or combination of mechanisms for coupling.

As shown *in* FIGS. 1-9, the coupling structure 115 may be positioned outwardly or downwardly away from the top portion and the base portion of the container lid 110. In some embodiments, the coupling structure 115 is positioned below the base portion of the container lid 110. In some embodiments, the coupling structure 115 may be a sleeve projected away from the base portion or the wall of the container lid 110. In some embodiments, the coupling structure 115 may encircle the base portion forming a rim that can fit over the top of the beverage or food container 120.

In some embodiments, the coupling structure 115 extends from the base portion or the wall of the container lid 110 and is adapted to engage an outer surface of the beverage or food container 120. In some embodiments, the coupling structure 115 protrudes from a bottom edge of the wall of the container lid 110.

In some embodiments, the coupling structure 115 may have a cross-section having substantially the same shape as other members (i.e., the top portion, the base portion) of the container lid 110. In some embodiments, the coupling structure 115 may have a larger or smaller circumference than the top portion or base portion of the container lid 110. In some embodiments, the coupling structure 115 may have the same circumference as the top portion or base portion of the container lid 110.

In some embodiments, the coupling structure 115 may be formed integrally with other members of the container lid 110.

In some embodiments, the shapes of the beverage or food container 120 or the container lid 110 are adapted for easy stacking *in* boxes for shipping and on shelves for display to a consumer. In some embodiments, the disclosed container assembly is stackable.

In some embodiments, a container assembly to various embodiments of this disclosure may include one or more stacking structures. For example, the top portion of the container lid 110 may have an upwardly or outwardly projected structure 111*a*, such as a structure having a dome shape, cone shape, bubble shape, or any other suitable shape. Such stacking structure may be substantially complementary with a recess of the bottom 122 of the beverage or food container 120, such that two or more container assemblies, as disclosed herein, can be stacked, with or without an additional support structure.

Additionally and/or alternatively, stacking of container assemblies may be based at least *in* part on coupling between an edge surface or edge portion 111*b* of the container lid 110 and an edge surface or edge portion of the bottom 122 of the beverage or food container 120. This type of stacking structure may be useful when the bottom 122 of the beverage or food container 120 has small or no recess.

In some embodiments, the top portion may include a surface having a shape adapted to complement a bottom surface of the beverage or food container 120, such that the container assembly is stackable above or below a second container assembly *in* a stacking direction. For example, the upper container assembly has a beverage or food container 120 containing a bottom recess that engages fully or partially with the top portion of a container lid 110 of the lower container assembly.

In some embodiments, stacking of the upper container assembly and the lower container assembly does not require complete engagement. In some embodiments, the bottom outer rim of the beverage or food container 120 of the upper container assembly is coupled to the top outer rim of the container lid 110 of the lower container assembly.

In some embodiments, the container lid 110 of a lower container assembly may have an edge surface that substantially fits a bottom edge of the beverage or food container 120 of an upper container assembly. In one example, as shown *in* FIGS. 1-4, the edge surface may be located at the top portion. In another example, as shown *in* FIGS. 6-9, the edge surface may be located at the base portion, e.g., above the coupling structure 115.

In some embodiments, the container lid 110 or the beverage or food container 120 is formed of a transparent material. In some embodiments, the container lid 110 may include a thermoplastic material. In some embodiments, the thermoplastic material may be selected from crylics, polymethyl-methacrylate (PMMA), acrylonitrile (e.g., acrylonitrile butadiene styrene (ABS) copolymers, polyacrylonitriles (PAN)), polyamideimide (PAI), polyimides (PI) (e.g., thermosplastic polyimides), aromatic thermoplastic polyesters (e.g., polyarylate), liquid crystal polymers, polycarbonates (PC), polydimethyl siloxane (PDMS), polyaryletherketones (PAEK), polyetheretherketones (PEEK), polyethylene naphthalene dicarboxylate (PEN), polyetherimides (PEI), polyetherketones (PEK), polyethylene, polyethersulfone, polysulphone (PSul) (e.g., aromatic polysulfones), polyethylene sulfide (PES), polyphenylene sulfide (PPS), polyethylene terephthalate (PET or PETE), low-density polyethylene (LDPE), high-density polyethylene (HDPE), polyglycolic acid (PGA), polylactic acids (PLA), polylactic-glycolic acid copolymers (PLGA), polyoxymethylene plastic (POM/Acetal), polyphenylene ethers (PPE or PPO), polypropylene (PP), polystyrene (PS), polytetrafluoro-ethylene (PTFE/TEFLON), polyvinylchloride (PVC), polyvinylidene fluoride (PVDF), thermoplastic elastomers, ultra-highmolecular-weight polyethylene (UHMWPE), natural or synthetic rubber, polyamides (PA), e.g., aliphatic polyamides, aromatic polyamides, semi-aromatic polyamides, nylons (e.g., polyamide-11 (nylon-11), polyamide-12 (nylon-12), polyamide-4,6, polyamide-6 (nylon-6), polyamide-6,10, polyamide-6,12, polyamide-6,6 (nylon-6,6), polyamide-6,9), and the mixtures of two or more thereof.

Figure 10:
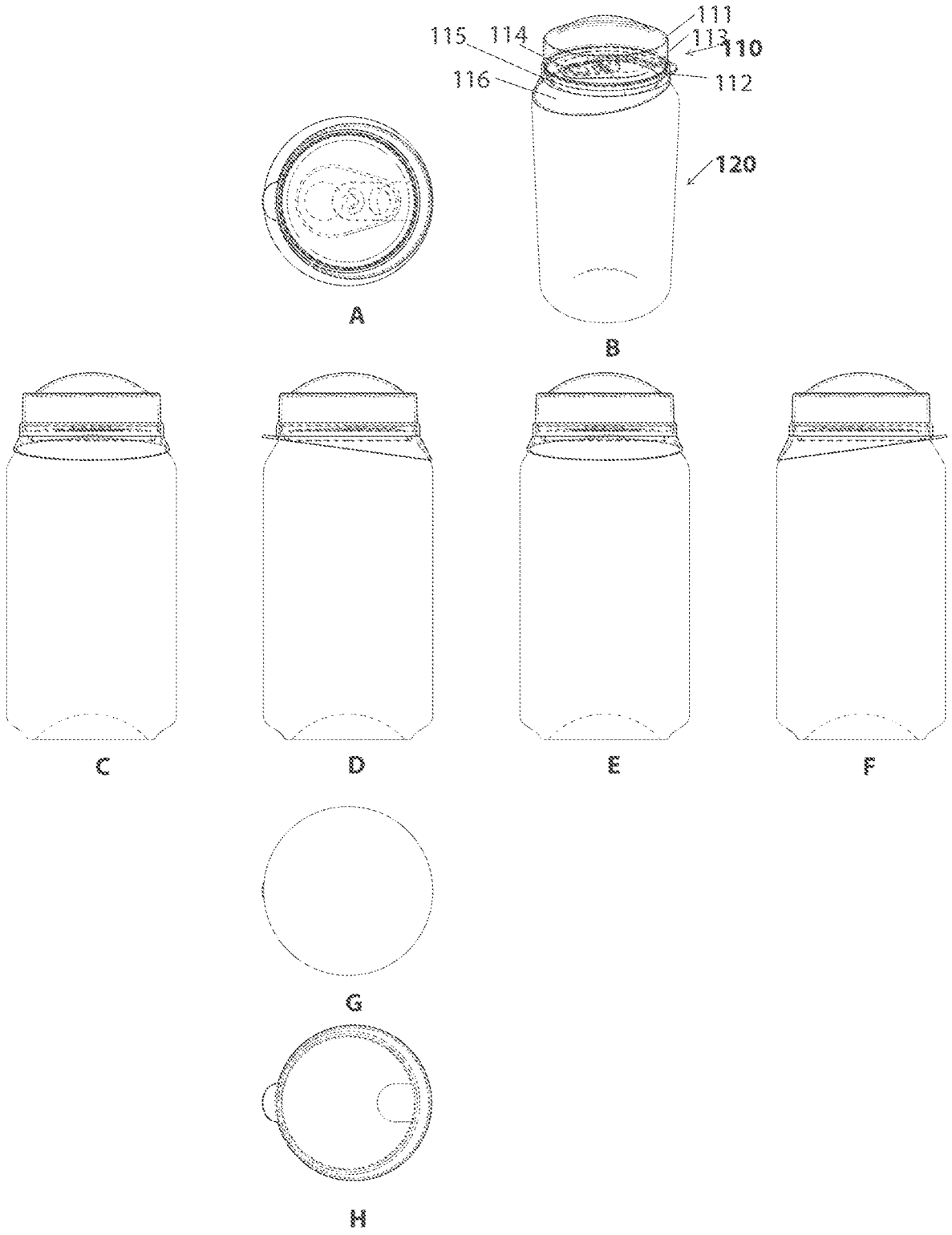
FIGS. 10A, 10B, 10C, 10D, 10E, 10F, 10G, and 10H (collectively "FIG. 10") shows an example container assembly having a beverage can and container lid containing a recessed coupling structure.
Figure 11:
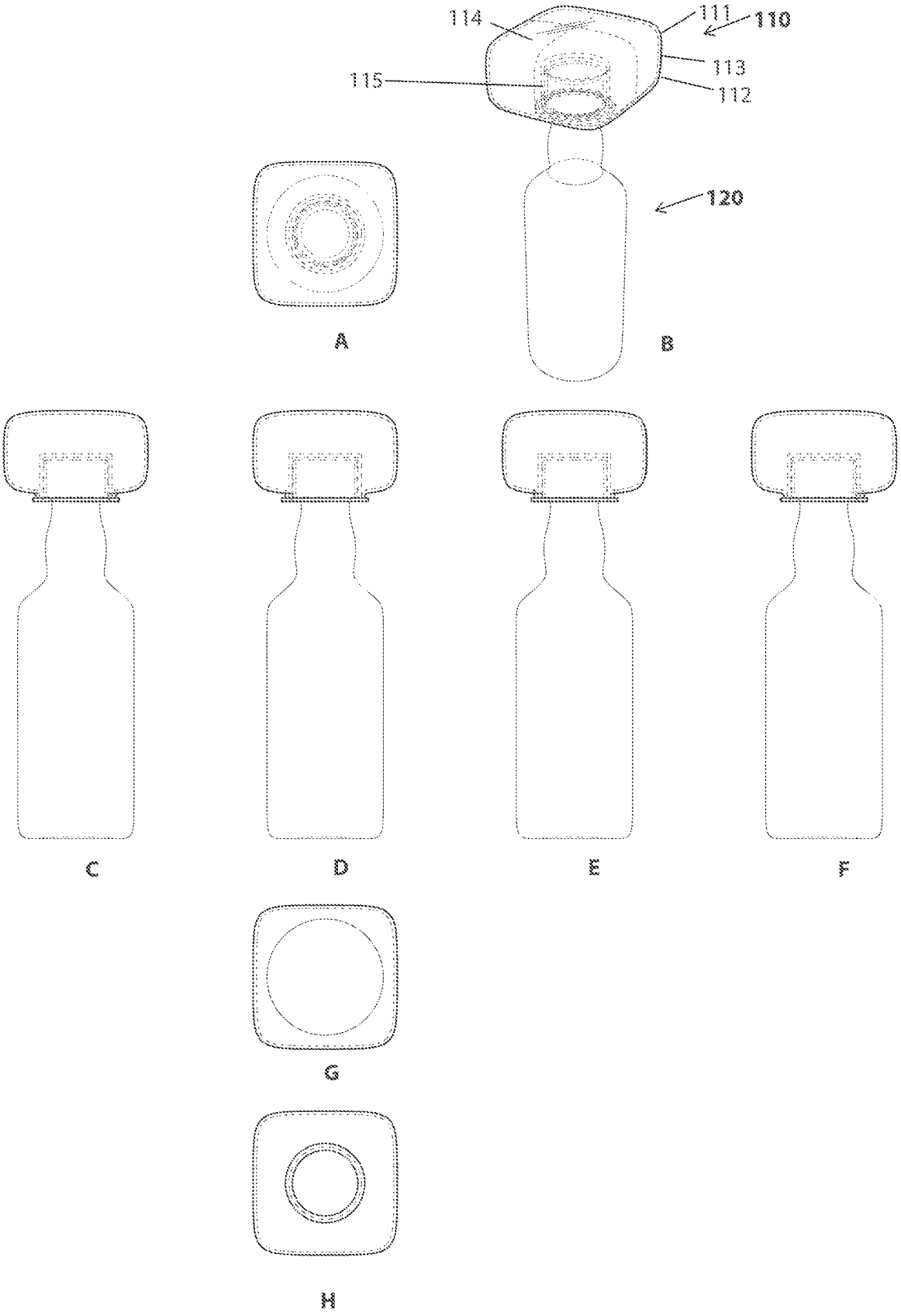
FIGS. 11A, 11B, 11C, 11D, 11E, 11F, 11G, and 11H (collectively "FIG. 11") shows an example container assembly having a beverage bottle and container lid containing a recessed coupling structure.
Figure 12:
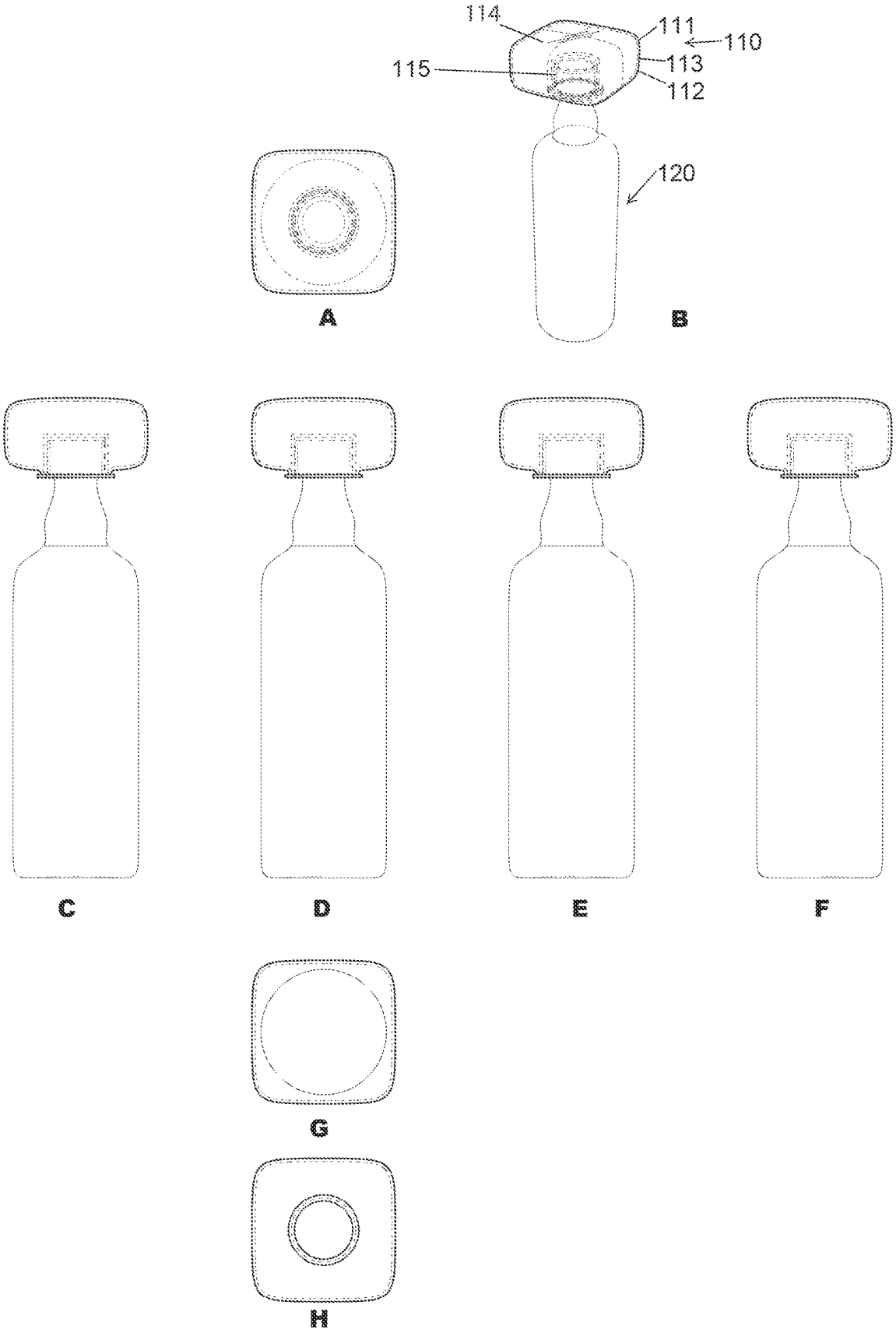
FIGS. 12A, 12B, 12C, 12D, 12E, 12F, 12G, and 12H (collectively "FIG. 12") shows an example container assembly having a beverage bottle and container lid containing a recessed coupling structure.
Figure 13:
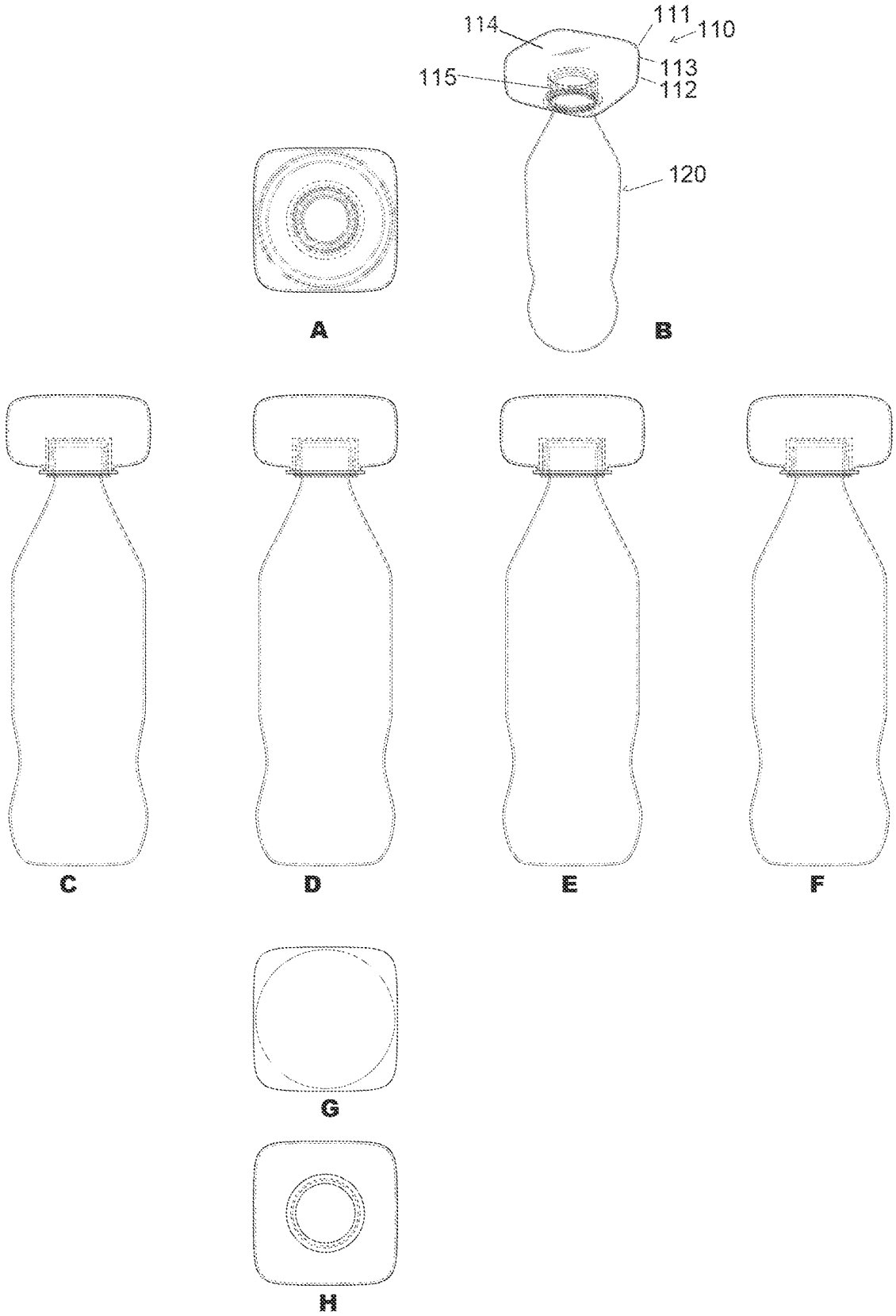
FIGS. 13A, 13B, 13C, 13D, 13E, 13F, 13G, and 13H (collectively "FIG. 13") shows an example container assembly having a beverage bottle and container lid containing a recessed coupling structure.
Figure 14:
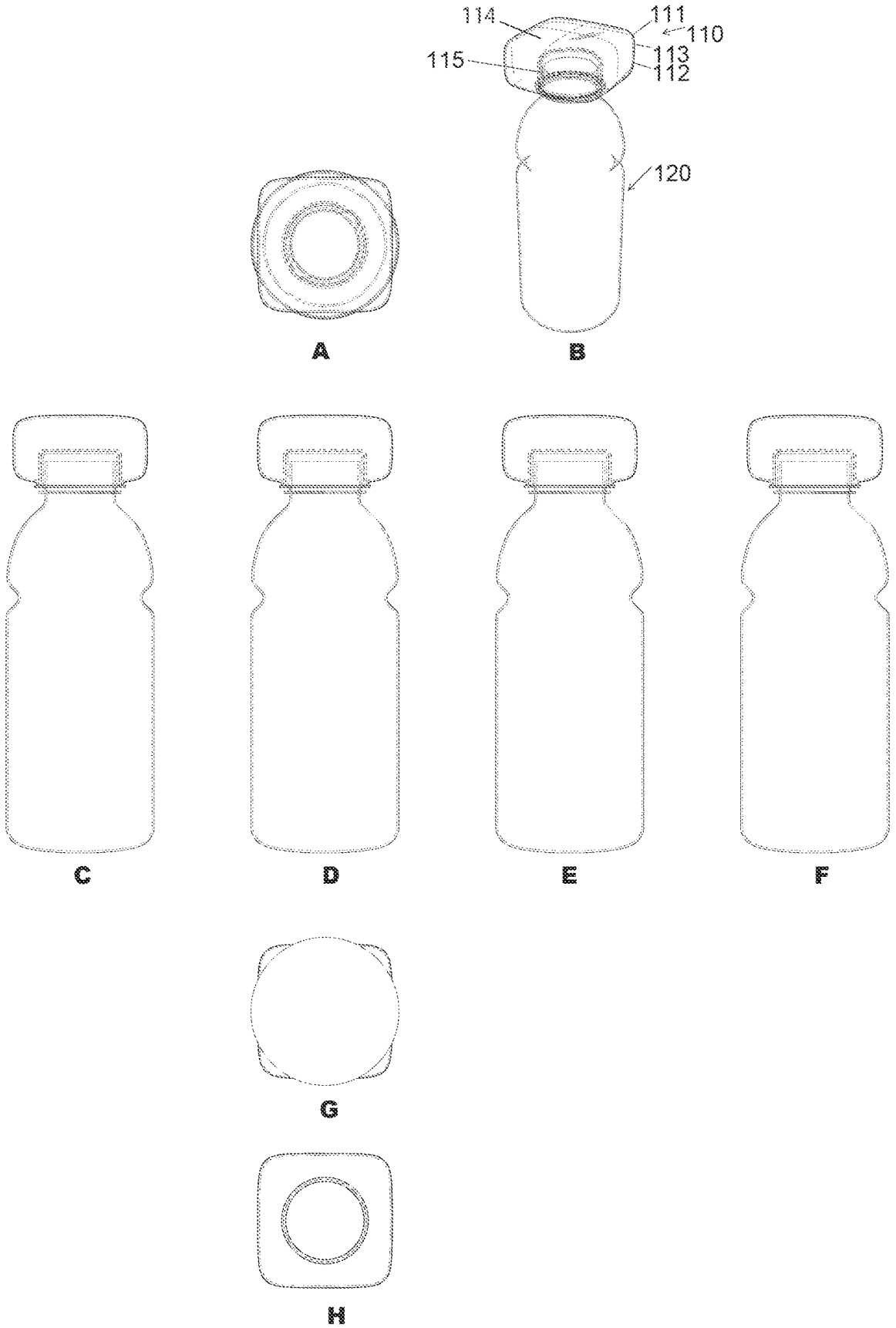
FIGS. 14A, 14B, 14C, 14D, 14E, 14F, 14G, and 14H (collectively "FIG. 14") shows an example container assembly having a beverage bottle and container lid containing a recessed coupling structure.

Referring now to FIG. 10, an example container assembly according to various embodiments of this disclosure is provided.

In some embodiments, the container lid 110 may include at least one spout 116 (e.g., pour spout) protruding downwardly from the base portion, the spout 116 adapted to aid unloading and mixing of the substance with the beverage or food contained within the beverage or food container 120. In some embodiments, the spout 116 may be a spill-proof spout and be substantially elongated.

In some embodiments, the spout is adapted to fit over the mouth 121 of the beverage or food container 120. In some embodiments, the spout 116 has an upper portion connecting with a least a portion of the wall or the base portion of the container lid 110, and a lower portion *in* contact with an outer surface of the beverage or food container 120.

In some embodiments, the spout 116 may be positioned in proximity to the opening such that the substance in the container lid 110 can be easily poured from the opening to the spout 116, and then to the beverage or food container. In some embodiments, a least a portion of the spout 116 and the opening are positioned on the same plane.

In some embodiments, the spout 116 is integrally formed with the container lid 110.

In some embodiments, the container lid 110 may be formed of a flexible material, such as a flexible thermoplastic material, such that when the container lid 110 is pressed on one or both sides, it will form a spout-like groove, enabling convenient unloading of the substance (e.g., dry fruit powder) from the container lid 110.

Referring now to FIGS. 11-14, an example container assembly according to various embodiments of this disclosure is provided. The container assembly may include a beverage bottle and a container lid 110 having a substantially cube shape. In some embodiments, the cube-shaped container lid 110 may have a top portion and a base portion that have a substantially square cross-sectional shape.

In some embodiments, the beverage bottle may include a bottle of any fluent products or beverage types (e.g., water, milk, vitamin, etc.). In some embodiments, the beverage bottle may include a bottle formed of any material, such as glass, plastic, aluminum, etc. In some embodiments, the beverage bottle may include a bottle formed of any sizes, such as 50 mL, 100 mL, 150 mL, 200 mL, 250 mL, 300 mL, 350 mL, 400 mL, 450 mL, 500 mL, 550 mL, 600 mL, 650 mL, 700 mL, 750 mL, 800 mL, 850 mL, 900 mL, 950 mL, 1000 mL, or more.

In some embodiments, unlike the container assemblies illustrated in FIGS. 1-9, the container assembly shown in FIGS. 11-14 may include a recessed coupling structure 115 that fits over at least a portion of the mouth 121 of the beverage container 120.

In such a configuration, the coupling structure 115 is positioned above the top portion of the container lid 110. In some embodiments, the coupling structure 115 may be positioned inwardly towards the top portion of the container lid 110.

Figure 15:
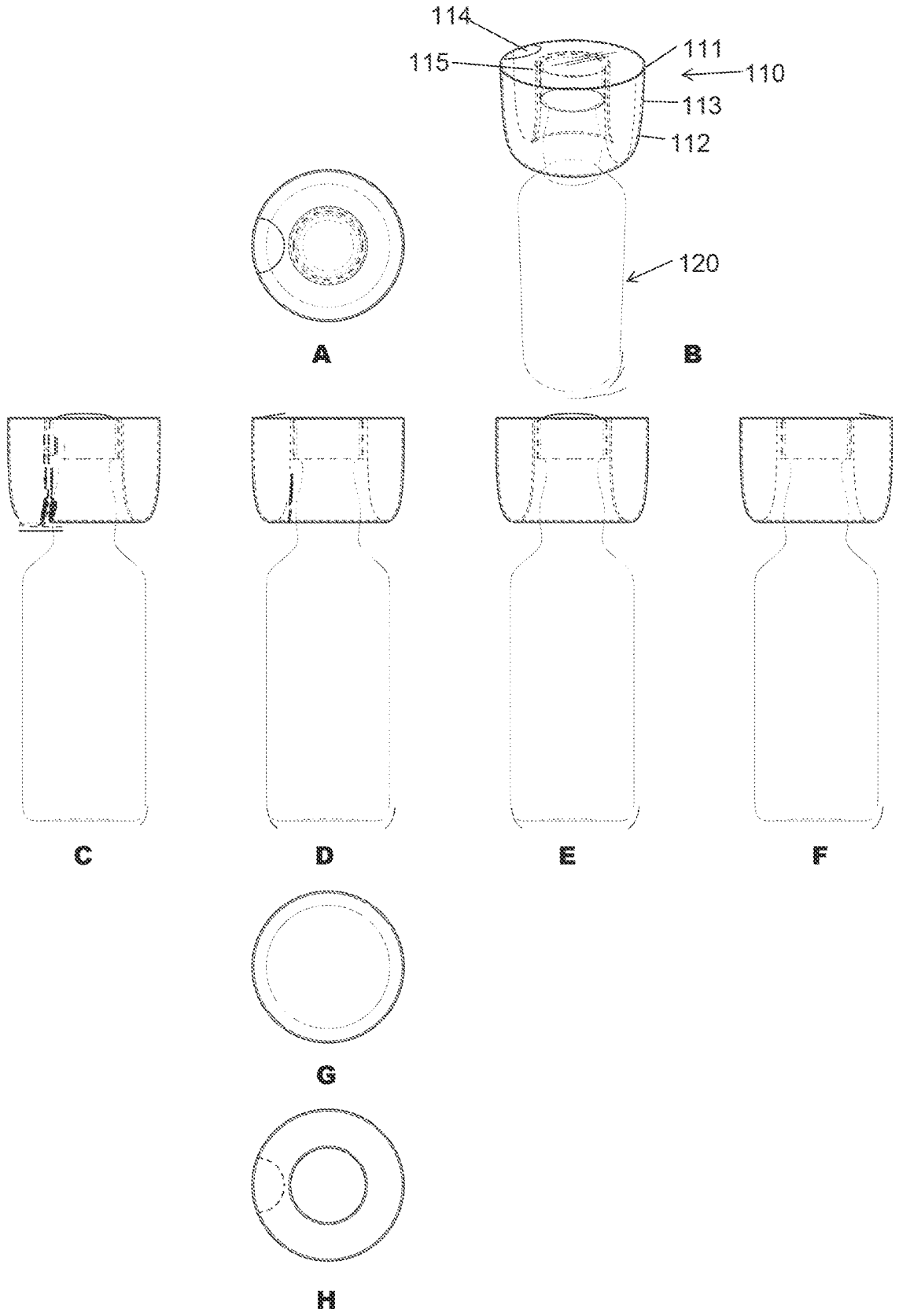
FIGS. 15A, 15B, 15C, 15D, 15E, 15F, 15G, and 15H (collectively "FIG. 15") shows an example container assembly having a beverage bottle and container lid containing a recessed coupling structure.
Figure 16:
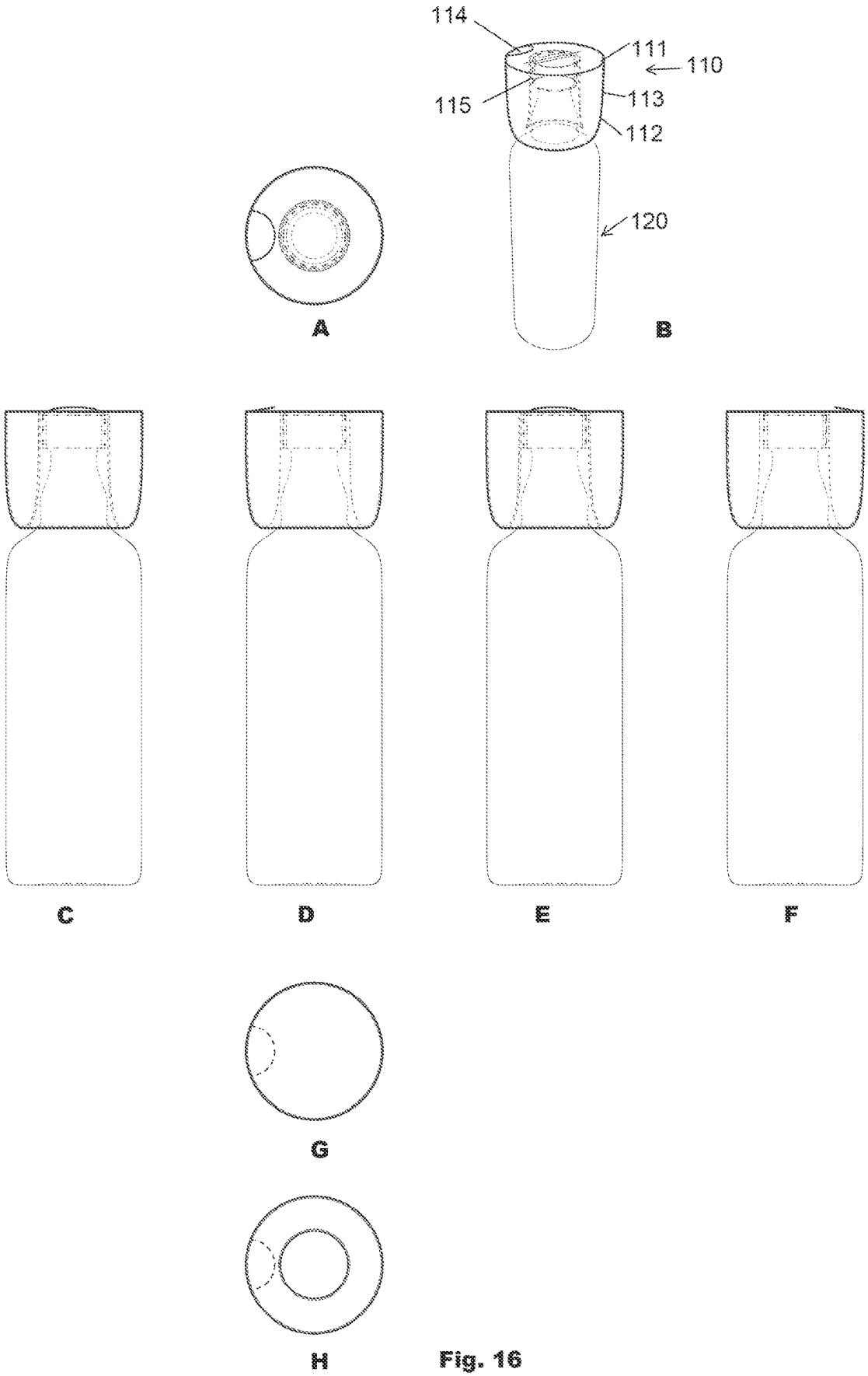
FIGS. 16A, 16B, 16C, 16D, 16E, 16F, 16G, and 16H (collectively "FIG. 16") shows an example container assembly having a beverage bottle and container lid containing a recessed coupling structure.
Figure 17:
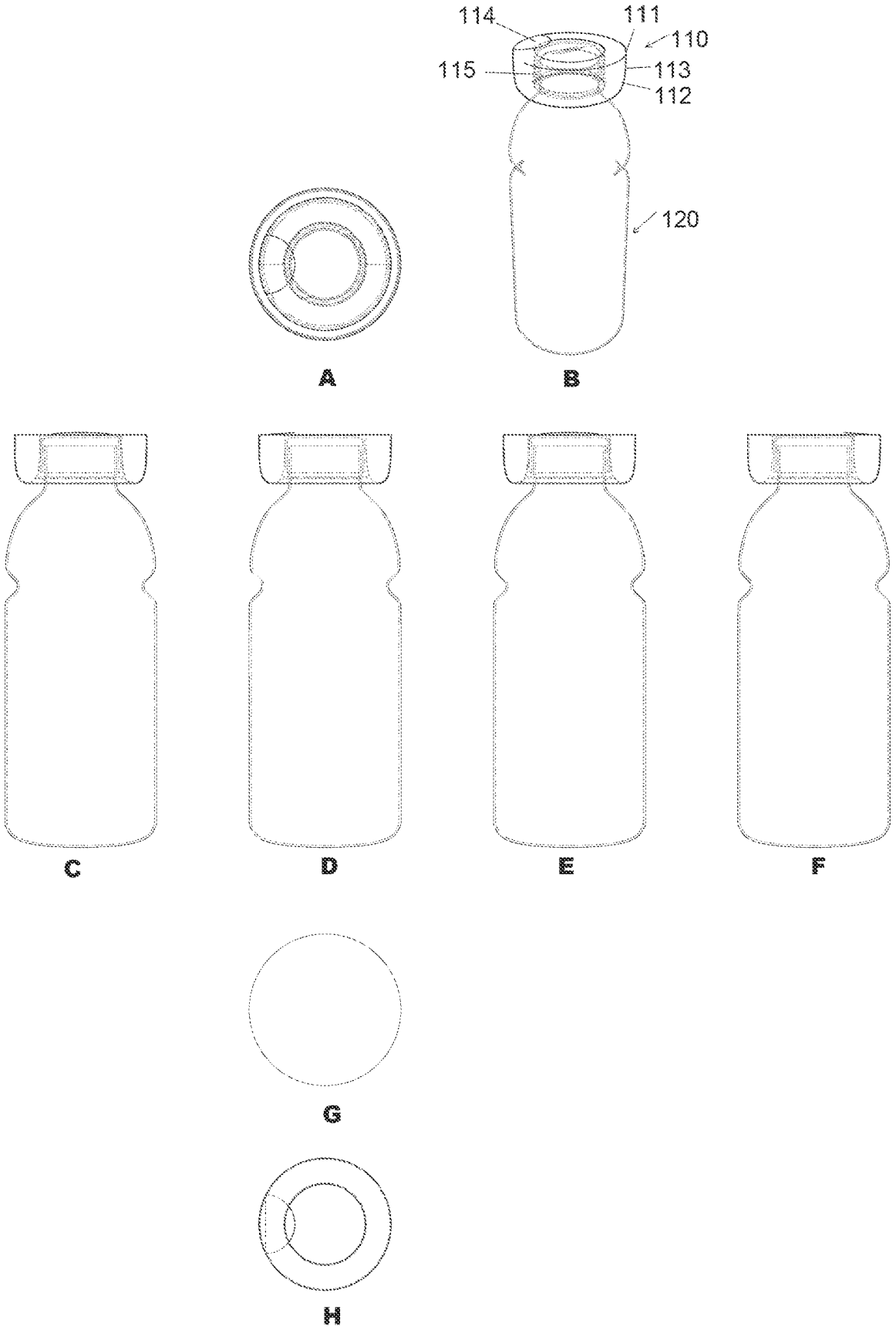
FIGS. 17A, 17B, 17C, 17D, 17E, 17F, 17G, and 17H (collectively "FIG. 17") shows an example container assembly having a beverage bottle and container lid containing a recessed coupling structure.
Figure 18:
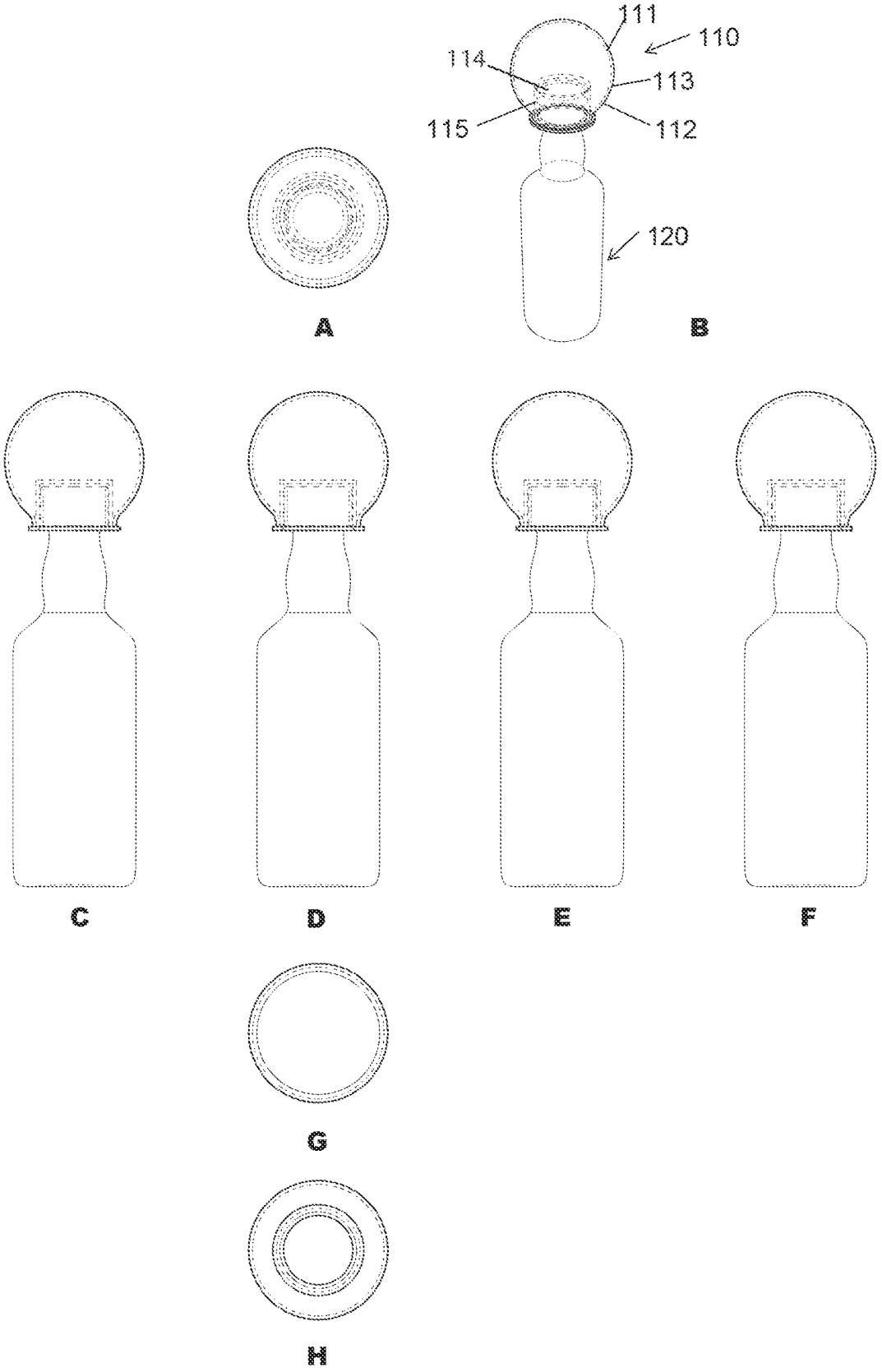
FIGS. 18A, 18B, 18C, 18D, 18E, 18F, 18G, and 18H (collectively "FIG. 18") shows an example container assembly having a beverage bottle and container lid containing a recessed coupling structure.
Figure 19:
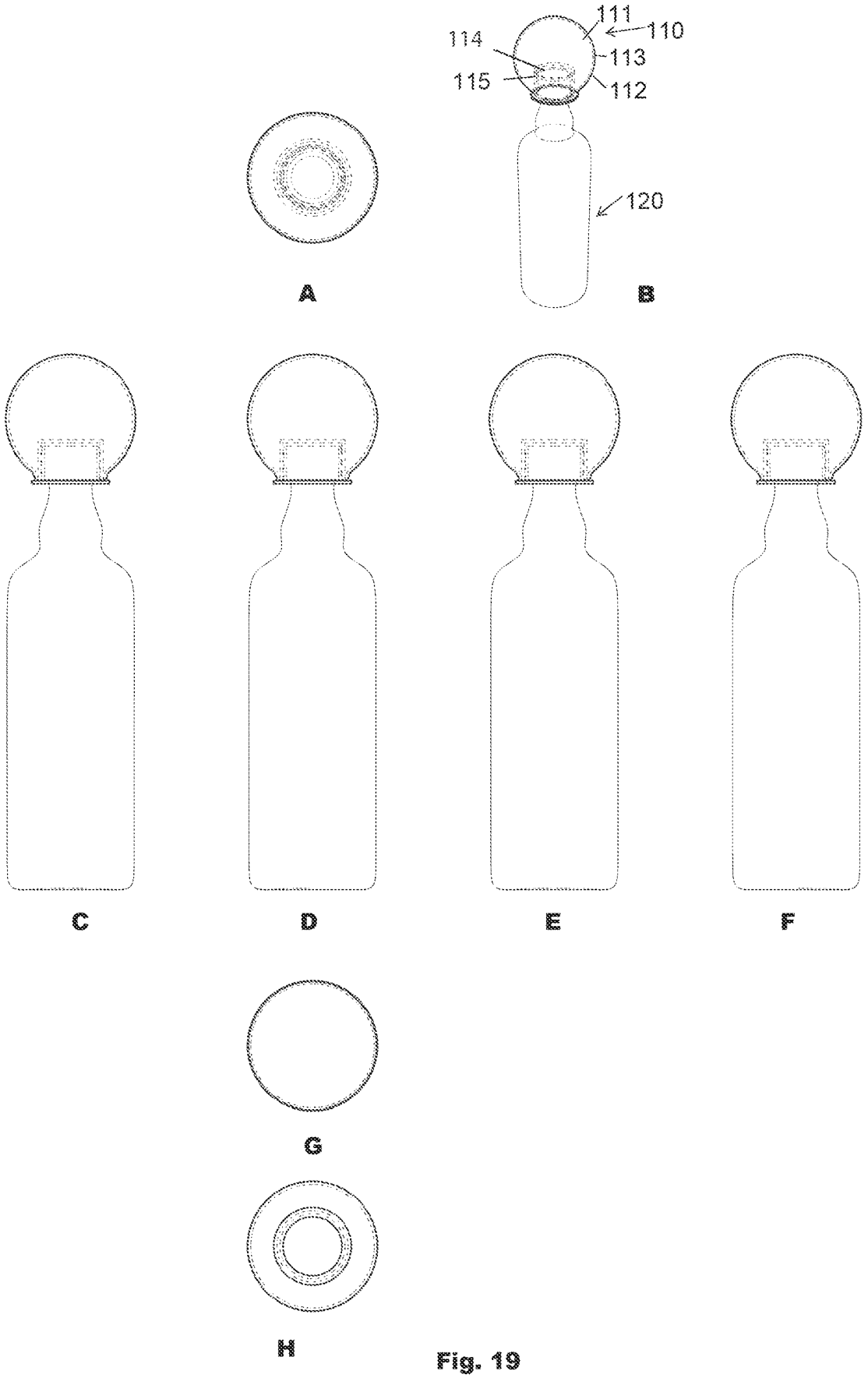
FIGS. 19A, 19B, 19C, 19D, 19E, 19F, 19G, and 19H (collectively "FIG. 19") shows an example container assembly having a beverage bottle and container lid containing a recessed coupling structure.
Figure 20:
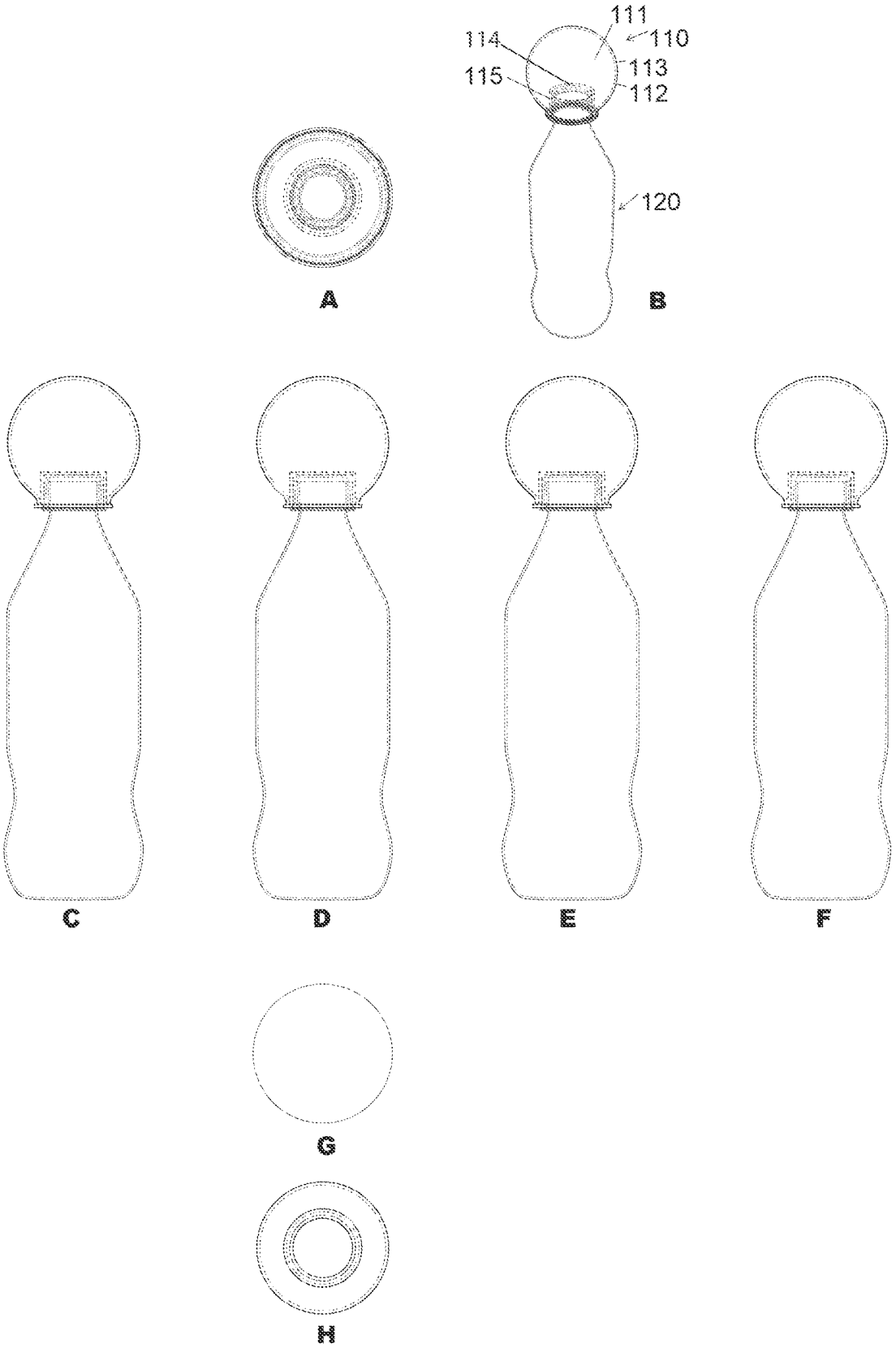
FIGS. 20A, 20B, 20C, 20D, 20E, 20F, 20G, and 20H (collectively "FIG. 20") shows an example container assembly having a beverage bottle and container lid containing a recessed coupling structure.
Figure 21:
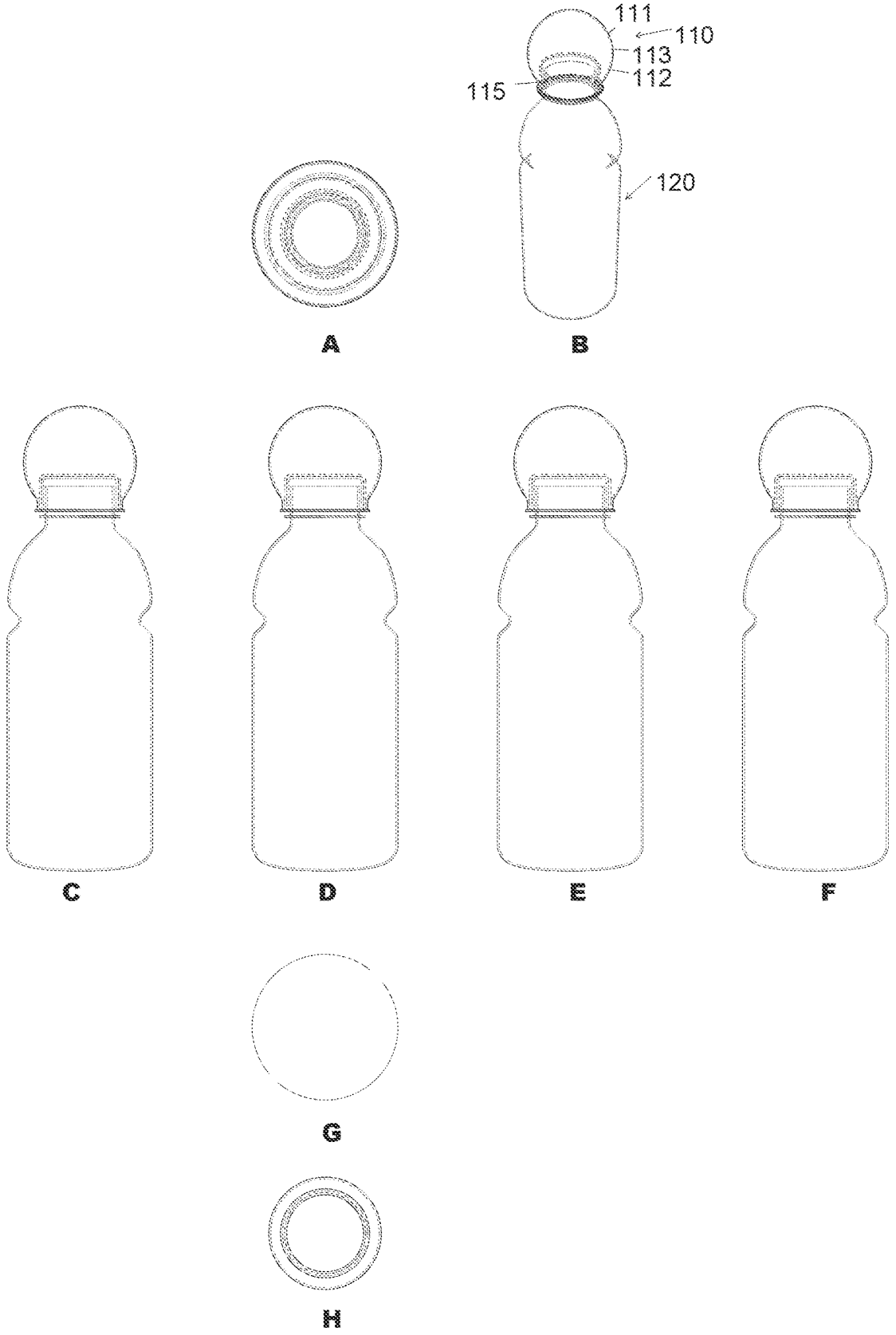
FIGS. 21A, 21B, 21C, 21D, 21E, 21F, 21G, and 21H (collectively "FIG. 21") shows an example container assembly having a beverage bottle and container lid containing a recessed coupling structure.
Figure 22:
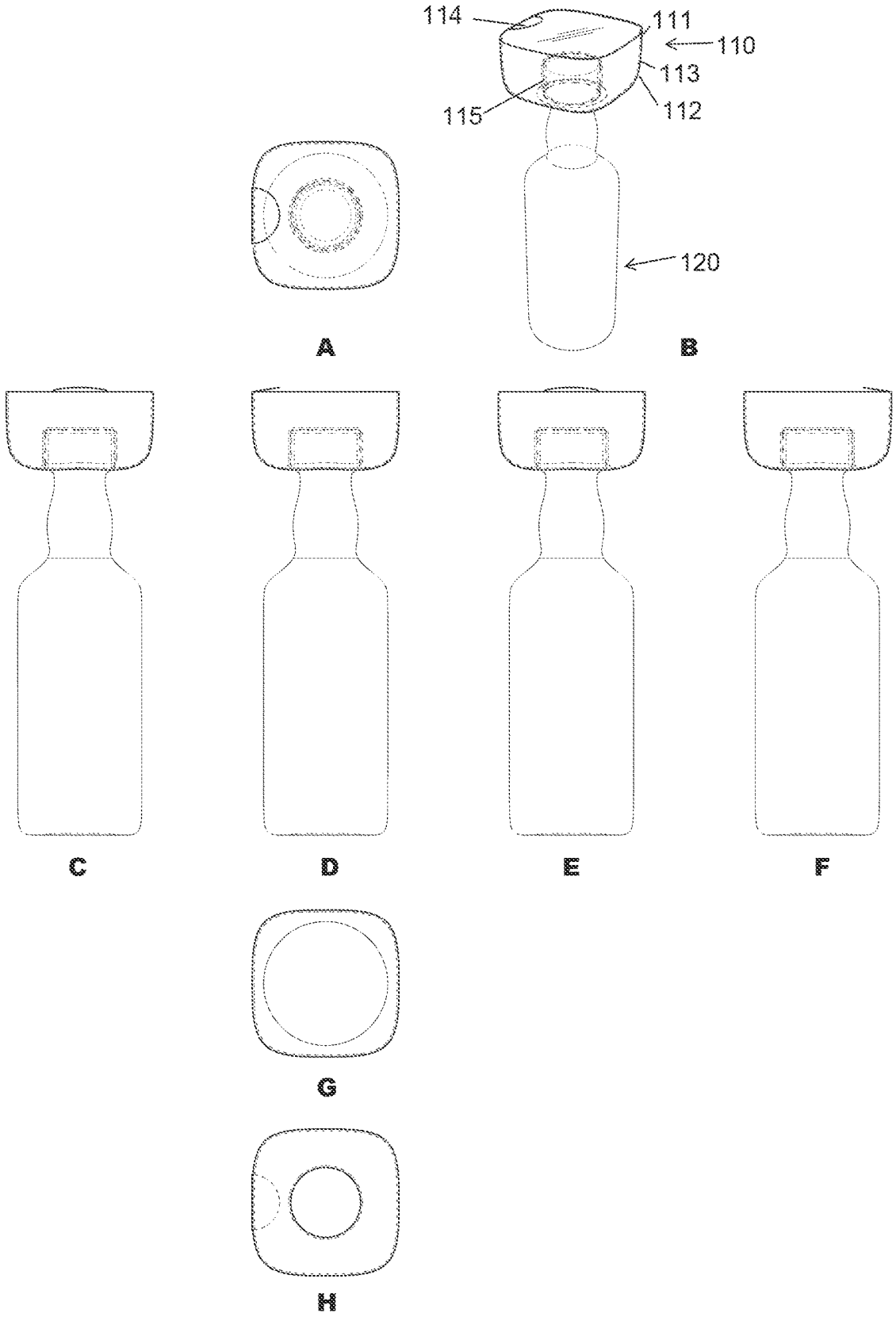
FIGS. 22A, 22B, 22C, 22D, 22E, 22F, 22G, and 22H (collectively "FIG. 22") shows an example container assembly having a beverage bottle and container lid containing a recessed coupling structure.
Figure 23:
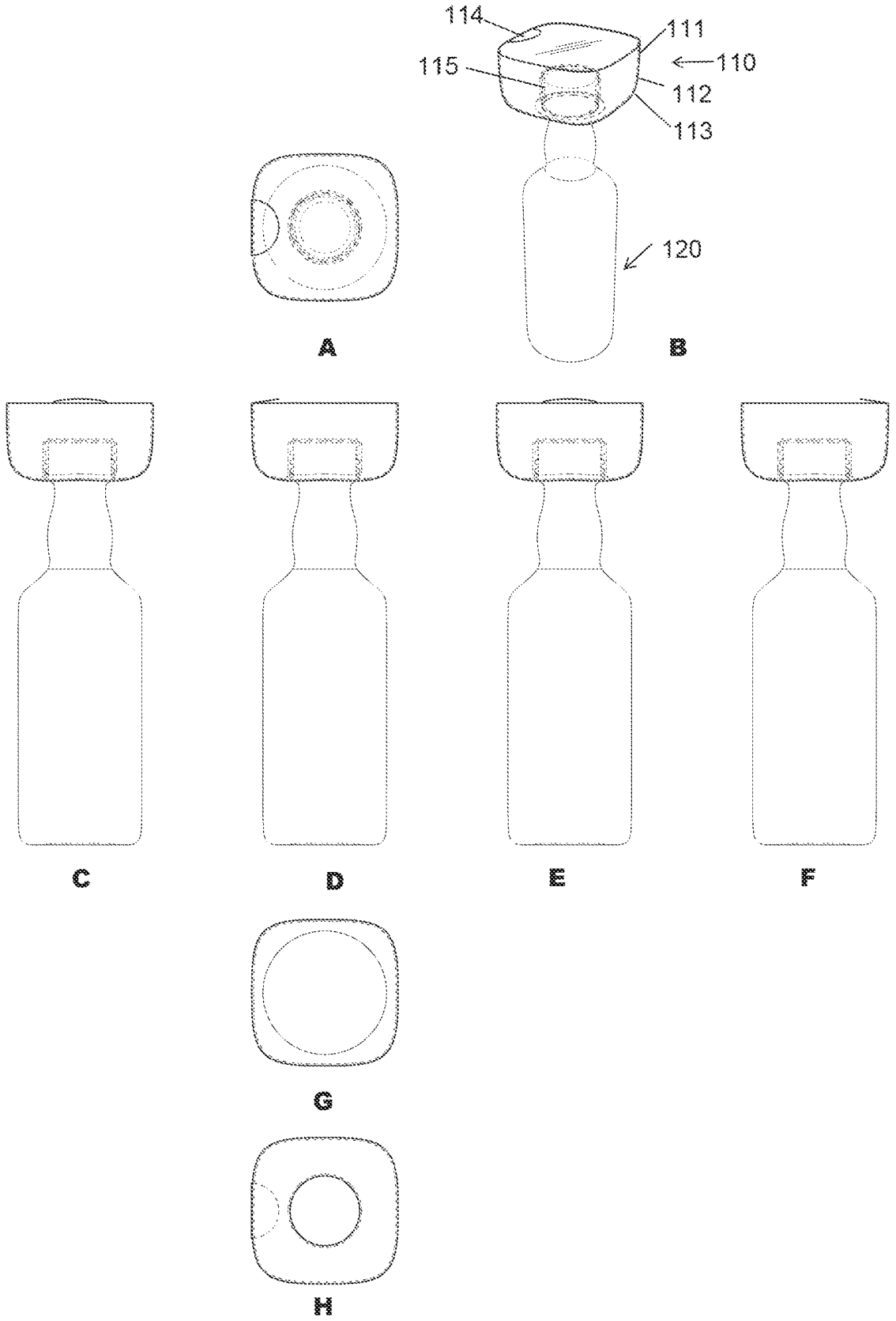
FIGS. 23A, 23B, 23C, 23D, 23E, 23F, 23G, and 23H (collectively "FIG. 23") shows an example container assembly having a beverage bottle and container lid containing a recessed coupling structure.
Figure 24:
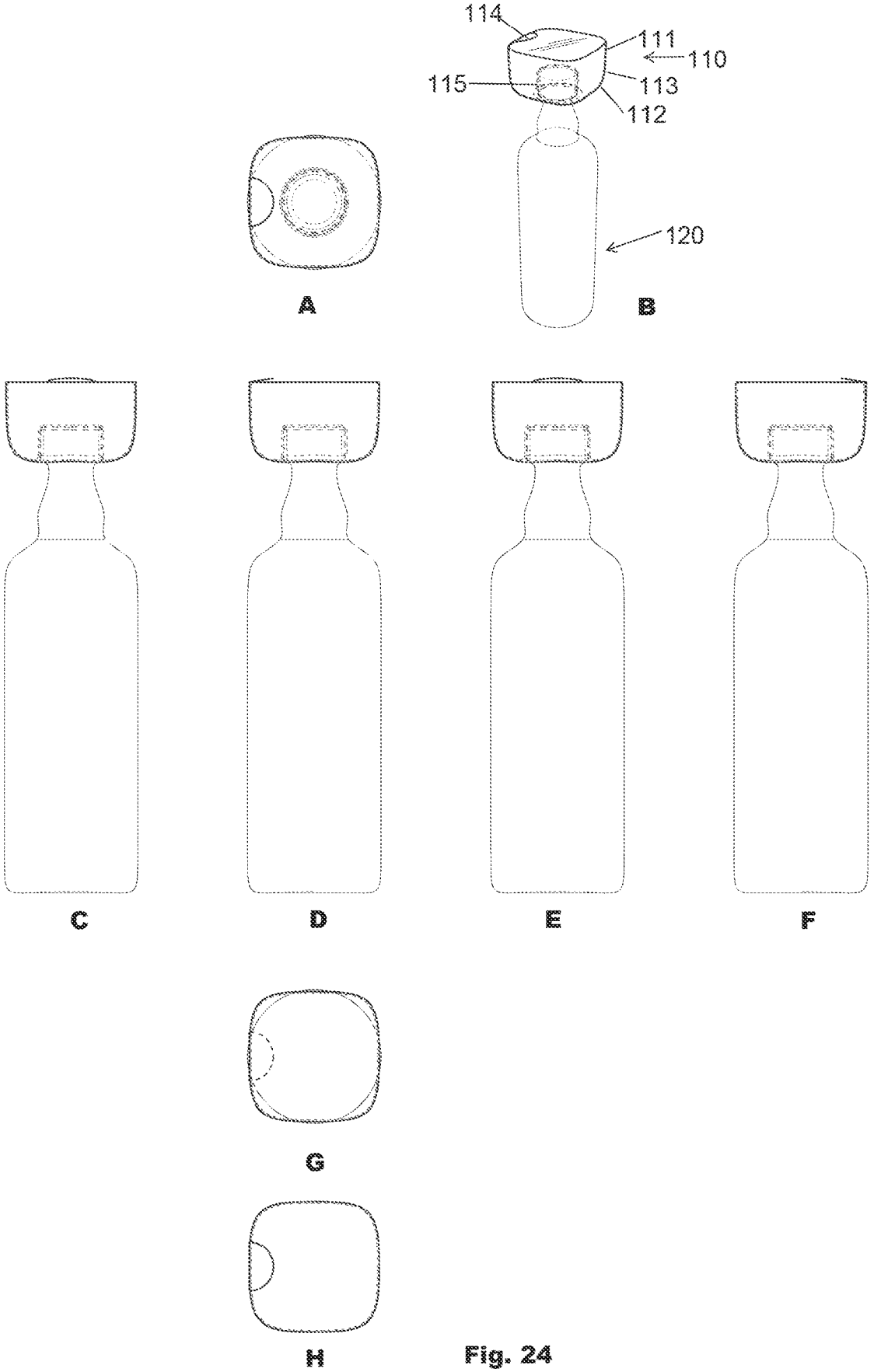
FIGS. 24A, 24B, 24C, 24D, 24E, 24F, 24G, and 24H (collectively "FIG. 24") shows an example container assembly having a beverage bottle and container lid containing a recessed coupling structure.
Figure 25:
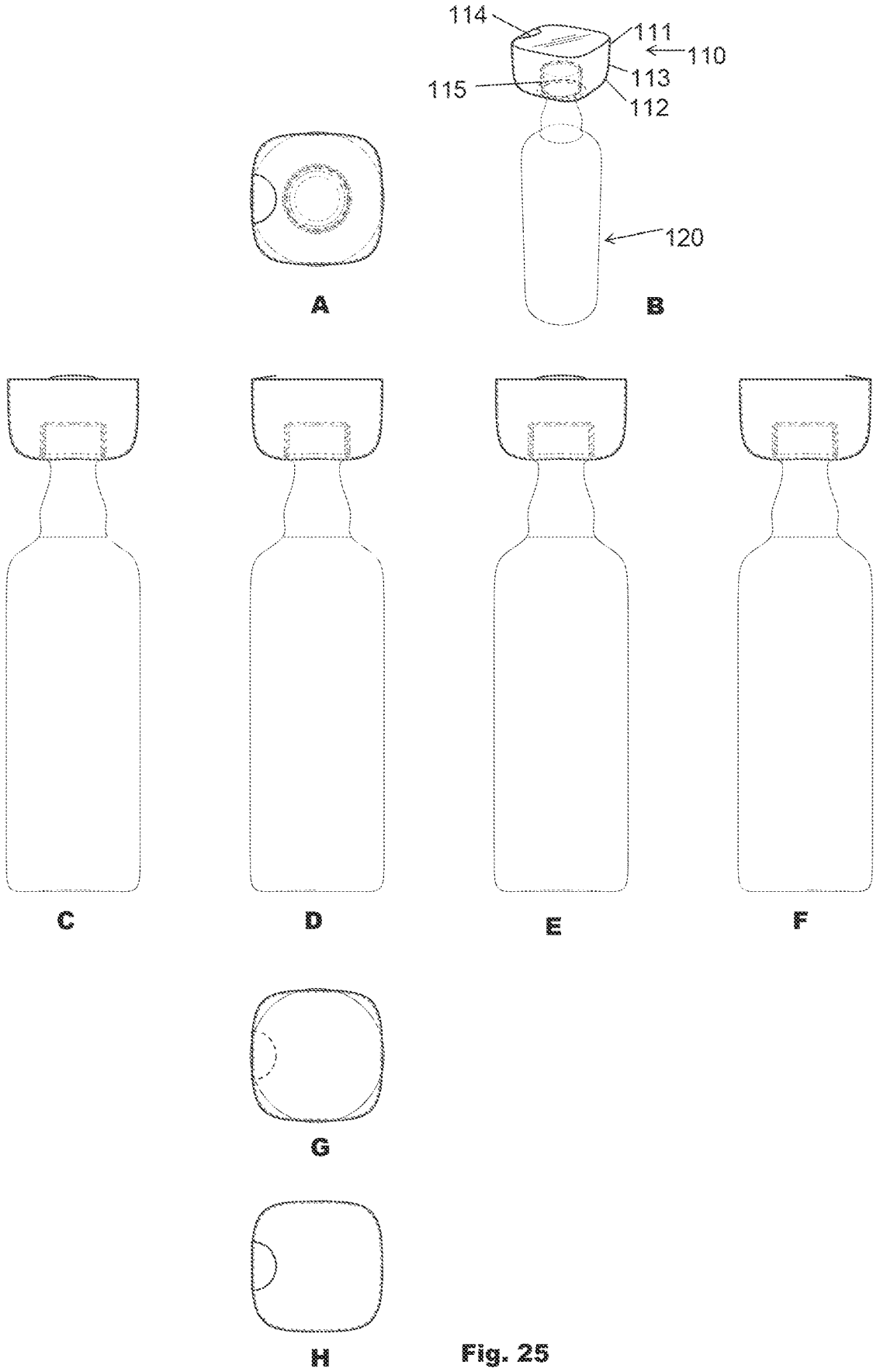
FIGS. 25A, 25B, 25C, 25D, 25E, 25F, 25G, and 25H (collectively "FIG. 25") shows an example container assembly having a beverage bottle and container lid containing a recessed coupling structure.
Figure 26:
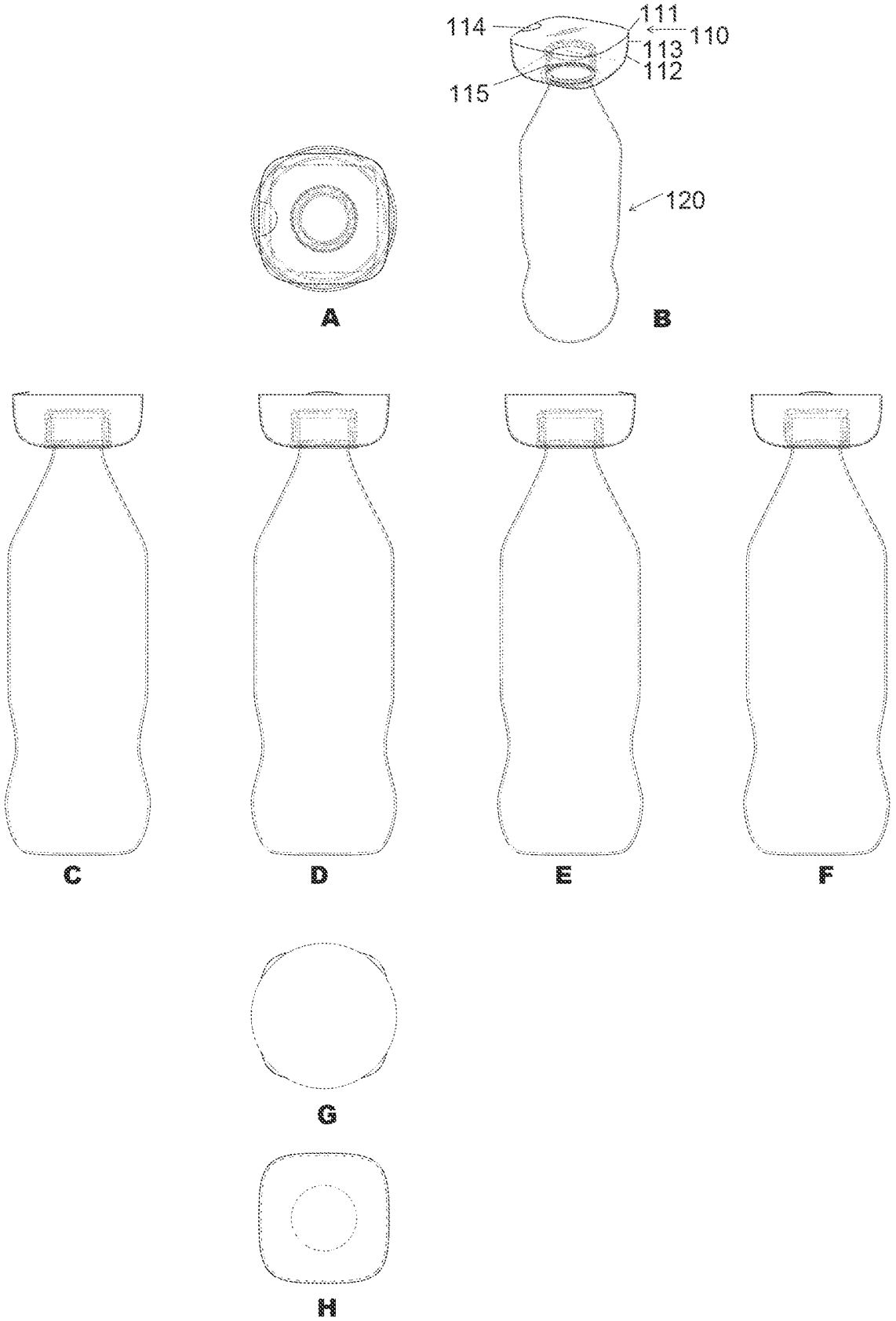
FIGS. 26A, 26B, 26C, 26D, 26E, 26F, 26G, and 26H (collectively "FIG. 26") shows an example container assembly having a beverage bottle and container lid containing a recessed coupling structure.
Figure 27:
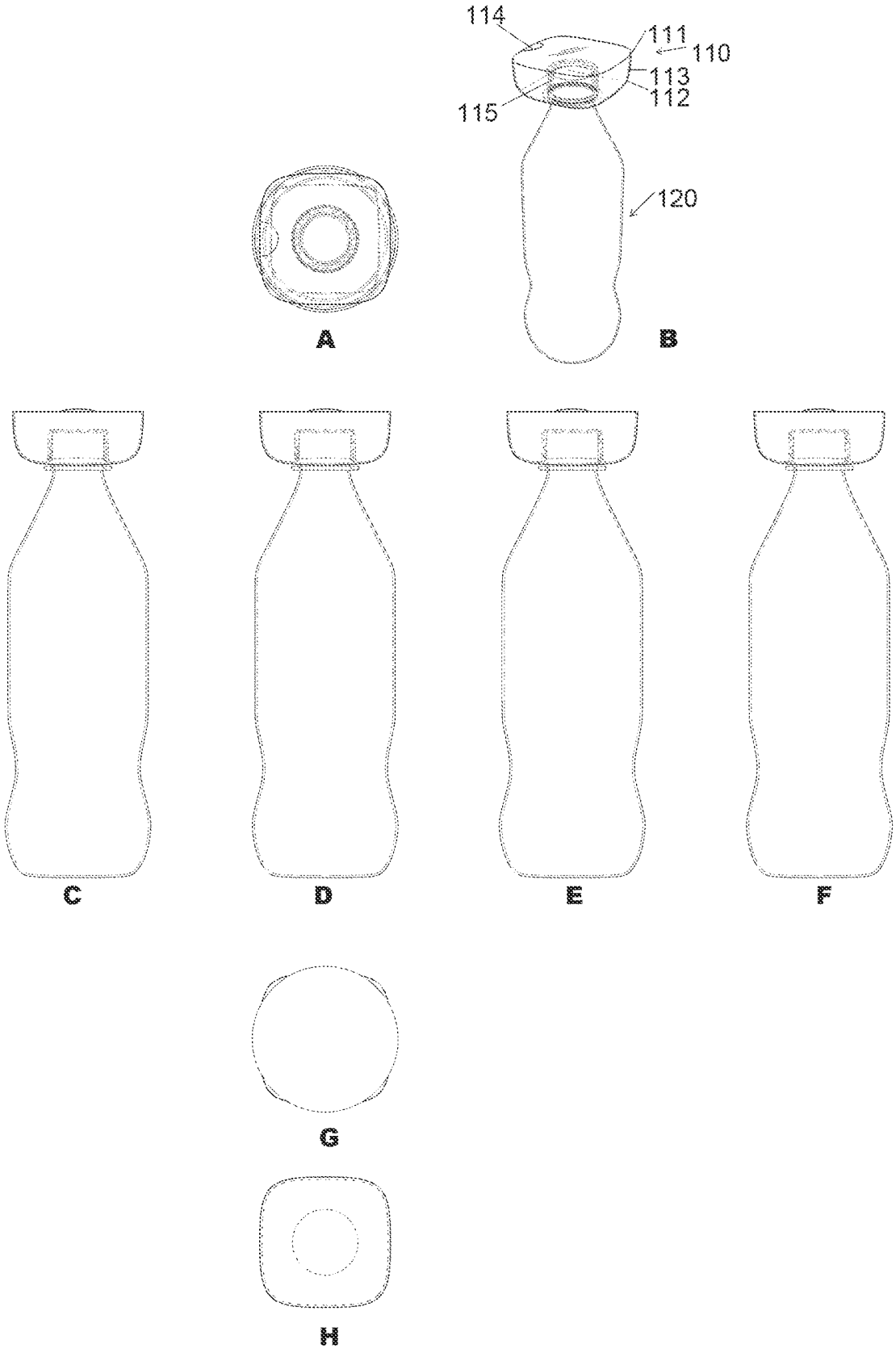
FIGS. 27A, 27B, 27C, 27D, 27E, 27F, 27G, and 27H (collectively "FIG. 27") shows an example container assembly having a beverage bottle and container lid containing a recessed coupling structure.
Figure 28:
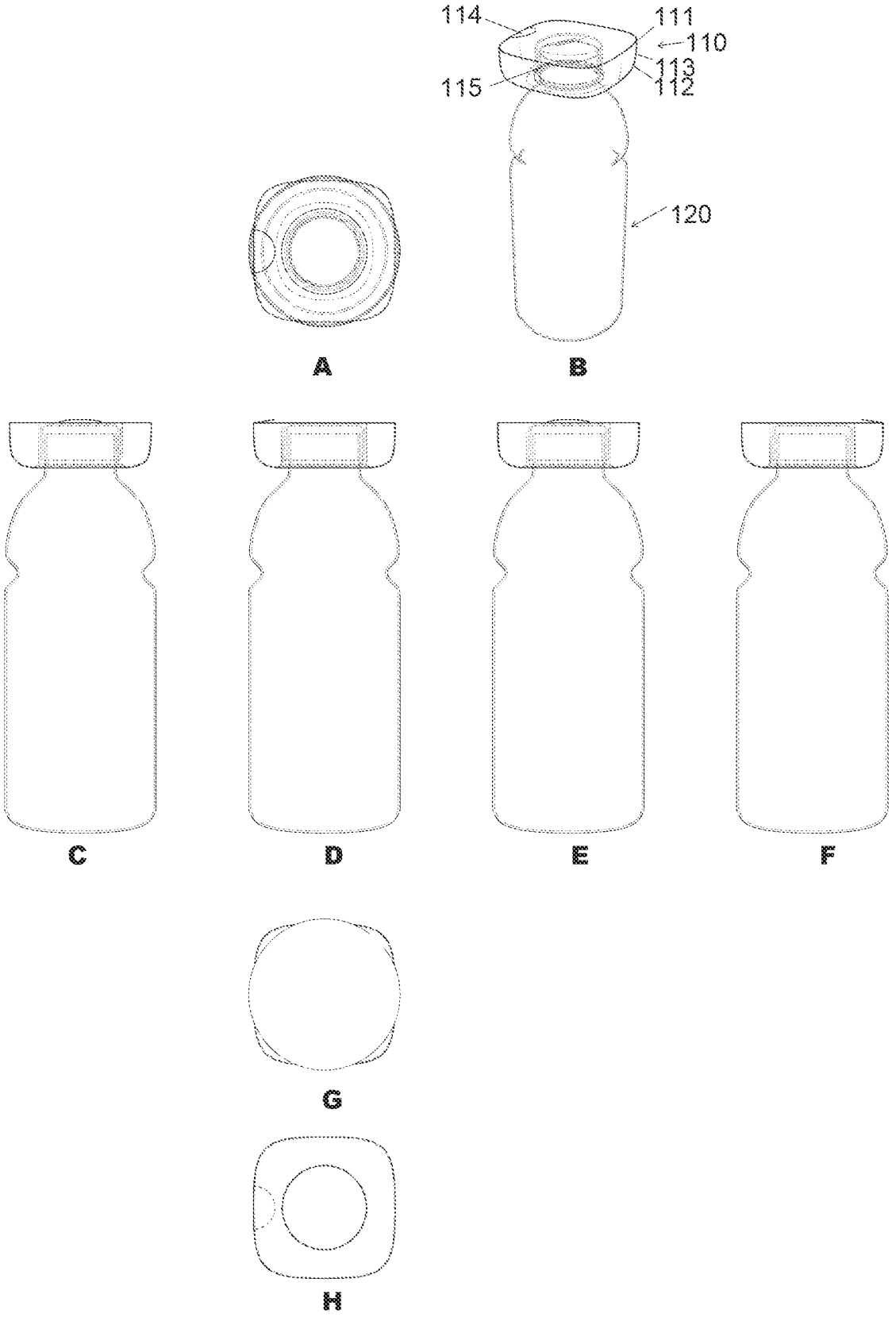
FIGS. 28A, 28B, 28C, 28D, 28E, 28F, 28G, and 28H (collectively "FIG. 28") shows an example container assembly having a beverage bottle and container lid containing a recessed coupling structure.
Figure 29:
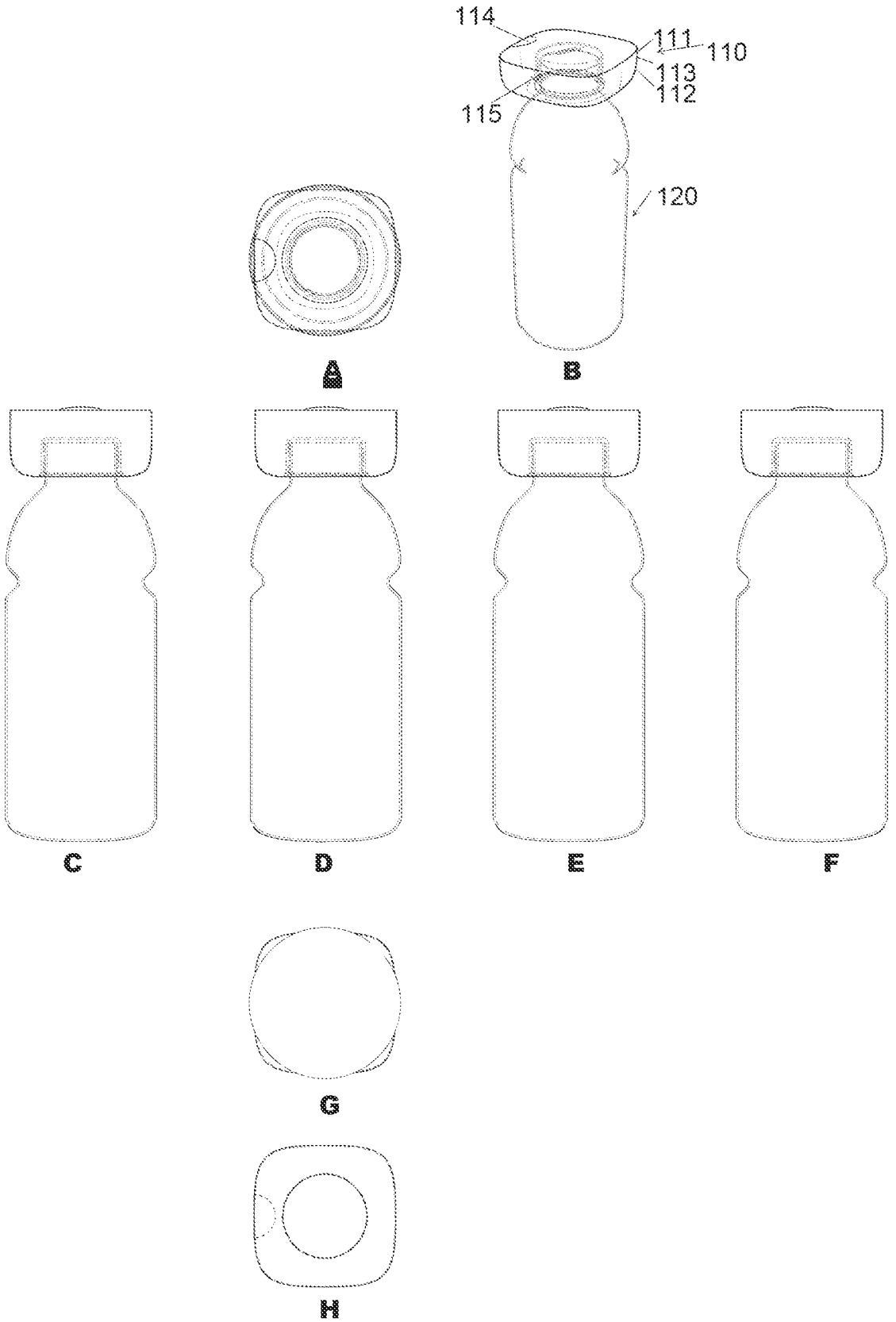
FIGS. 29A, 29B, 29C, 29D, 29E, 29F, 29G, and 29H (collectively "FIG. 29") shows an example container assembly having a beverage bottle and container lid containing a recessed coupling structure.
Figure 30:
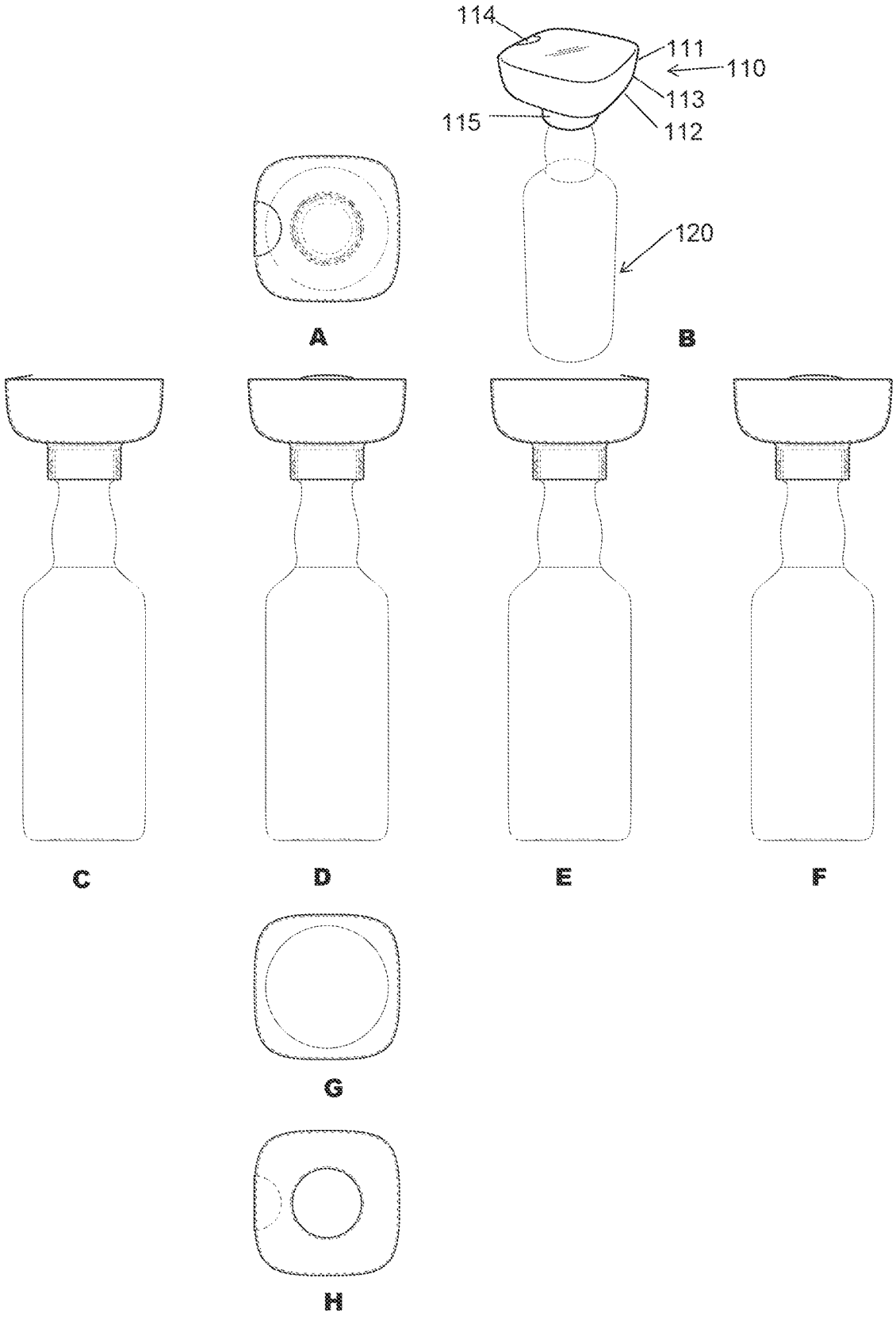
FIGS. 30A, 30B, 30C, 30D, 30E, 30F, 30G, and 30H (collectively "FIG. 30") shows an example container assembly having a beverage bottle and container lid containing a protruded coupling structure.
Figure 31:
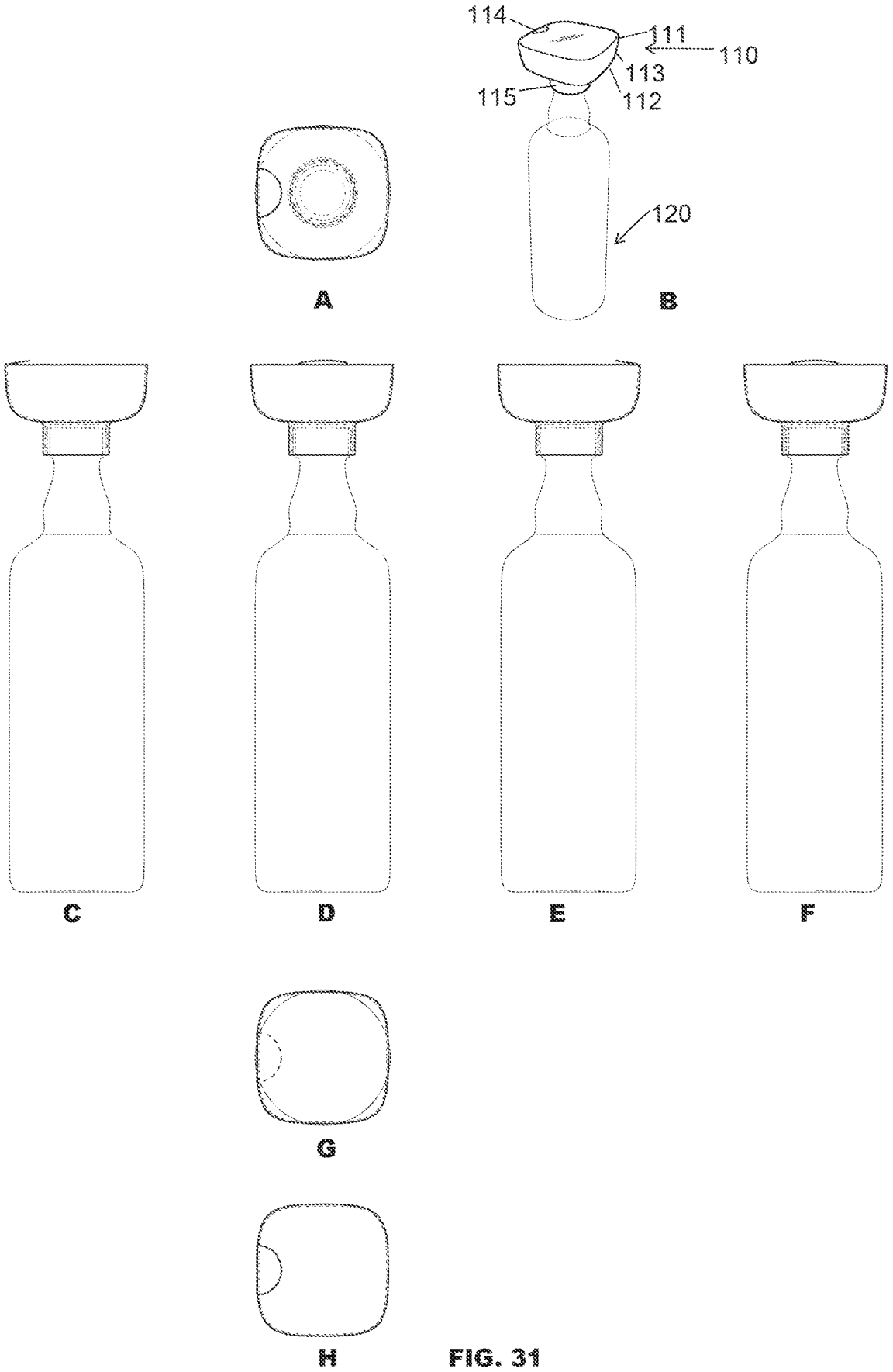
FIGS. 31A, 31B, 31C, 31D, 31E, 31F, 31G, and 31H (collectively "FIG. 31") shows an example container assembly having a beverage bottle and container lid containing a protruded coupling structure.
Figure 32:
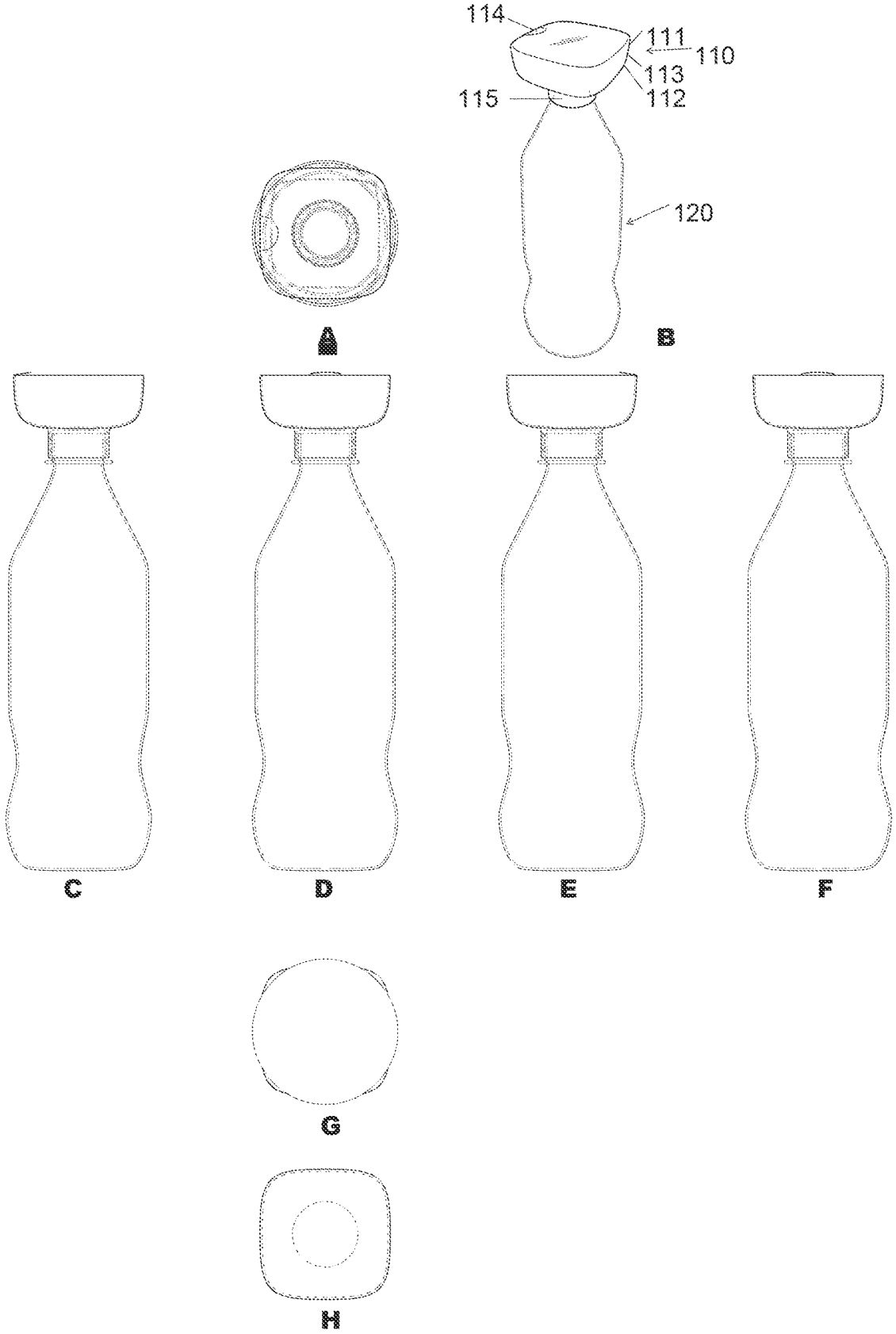
FIGS. 32A, 32B, 32C, 32D, 32E, 32F, 32G, and 32H (collectively "FIG. 32") shows an example container assembly having a beverage bottle and container lid containing a protruded coupling structure.
Figure 33:
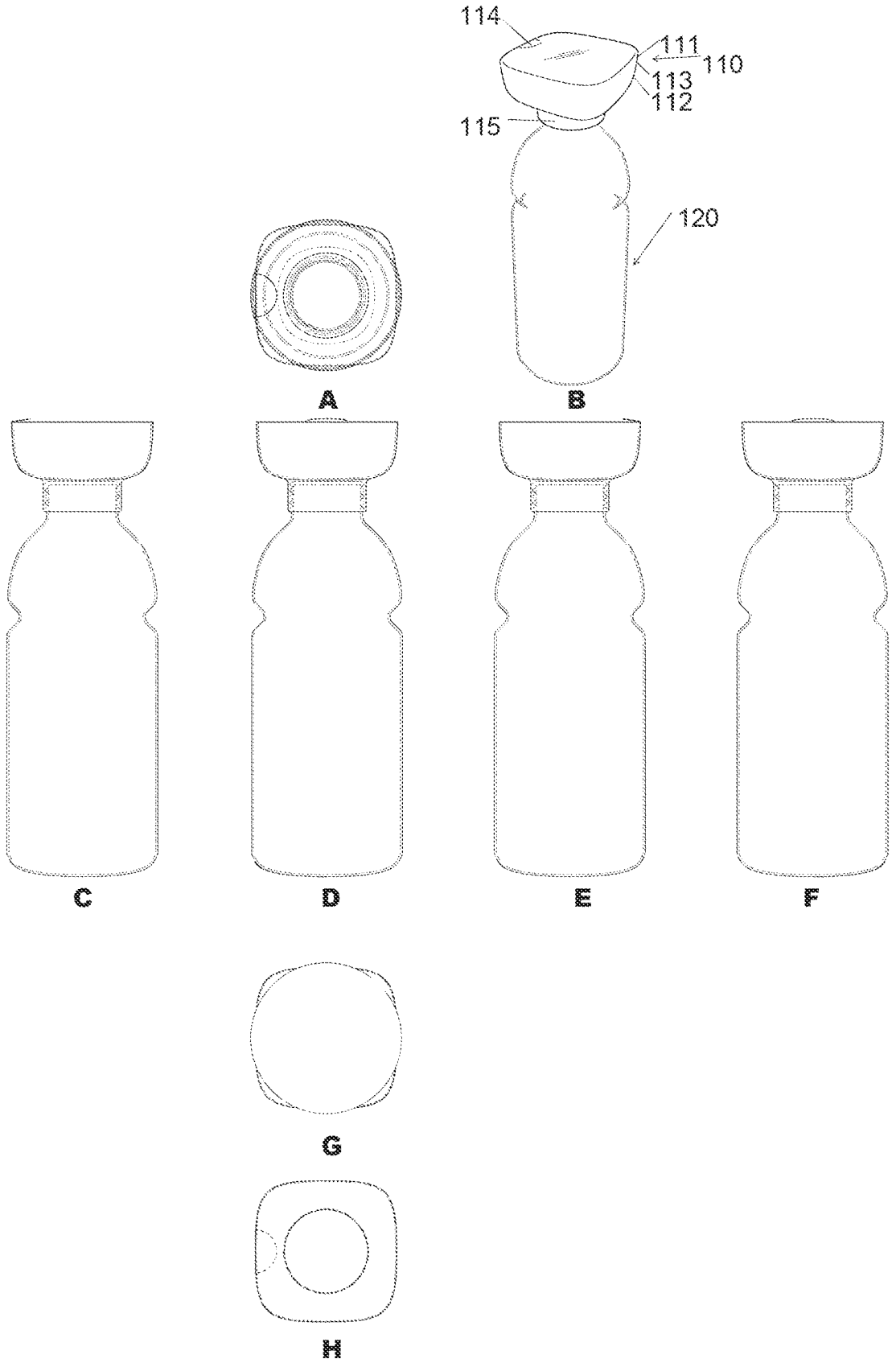
FIGS. 33A, 33B, 33C, 33D, 33E, 33F, 33G, and 33H (collectively "FIG. 33") shows an example container assembly having a beverage bottle and container lid containing a protruded coupling structure.

In another example, as shown in FIGS. 15-17, the container lid 110 has a substantially round shape. In some embodiments, the container lid 110 may have a recessed coupling structure 115. In some embodiments, the coupling structure 115 may extend from the bottom surface of the base portion of the container lid to the top surface of the top portion of the container lid 110.

In some embodiments, the container lid 110 may include an inner wall extending upwardly from the base portion, and wherein the inner wall forms a least a portion of the coupling structure 115.

In some embodiments, the recessed coupling structure 115 may removably engage with the mouth 121 of the beverage or food container 120 by any suitable means, including but not limited to, complementary threading, snap-fit or friction-fit means, bayonet means, or any other suitable mechanism or combination of mechanisms for coupling, as will be appreciated by those skilled in the art.

In some embodiments, the coupling structure 115 may include screw thread adapted to secure the container lid 110 to the beverage or food container 120.

Turning now to FIGS. 18-21, an example container assembly according to various embodiments of this disclosure is illustrated. The container assembly may include a beverage bottle and a container lid 110 that has a substantially sphere shape. In some embodiments, the sphere-shaped container lid 110 may have a recessed coupling structure 115 that extends inwardly from the bottom surface of the base portion of the container lid 110. As stated above, the recessed coupling structure 115 may removably engage with the mouth 121 of the beverage or food container 120 by any suitable means, including but not limited to, complementary threading, snap-fit or friction-fit means, bayonet means, or any other suitable mechanism or combination of mechanisms for coupling, as will be appreciated by those skilled in the art.

FIGS. 22-29 illustrate an example container assembly according to various embodiments of this disclosure. The container assembly may include a beverage bottle and a container lid 110 that has a substantially squircle shape. In some embodiments, the squircle-shaped container lid 110 may have a recessed coupling structure 115 that extends inwardly from the bottom surface of the base portion of the container lid 110. As stated above, the recessed coupling structure 115 may removably engage with the mouth 121 of the beverage or food container 120 by any suitable means, including but not limited to, complementary threading, snap-fit or friction-fit means, bayonet means, or any other suitable mechanism or combination of mechanisms for coupling, as will be appreciated by those skilled in the art. In some embodiments, the coupling structure 115 may include screw thread adapted to secure the container lid 110 to the beverage or food container 120.

FIGS. 30-33 illustrate an example container assembly according to various embodiments of this disclosure. The container assembly may include a beverage bottle and a container lid 110 that may have a substantially cube, round, sphere, or squircle shape.

In some embodiments, the container lid 110 may have a coupling structure 115 that extends outwardly from the bottom surface of the base portion of the container lid 110. As stated above, the recessed coupling structure 115 may removably engage with the mouth 121 of the beverage or food container 120 by any suitable means, including but not limited to, complementary threading, snap-fit or friction-fit means, bayonet means, or any other suitable mechanism or combination of mechanisms for coupling, as will be appreciated by those skilled in the art. In some embodiments, the coupling structure 115 may include screw thread adapted to secure the container lid 110 to the beverage or food container 120.

Figure 34:
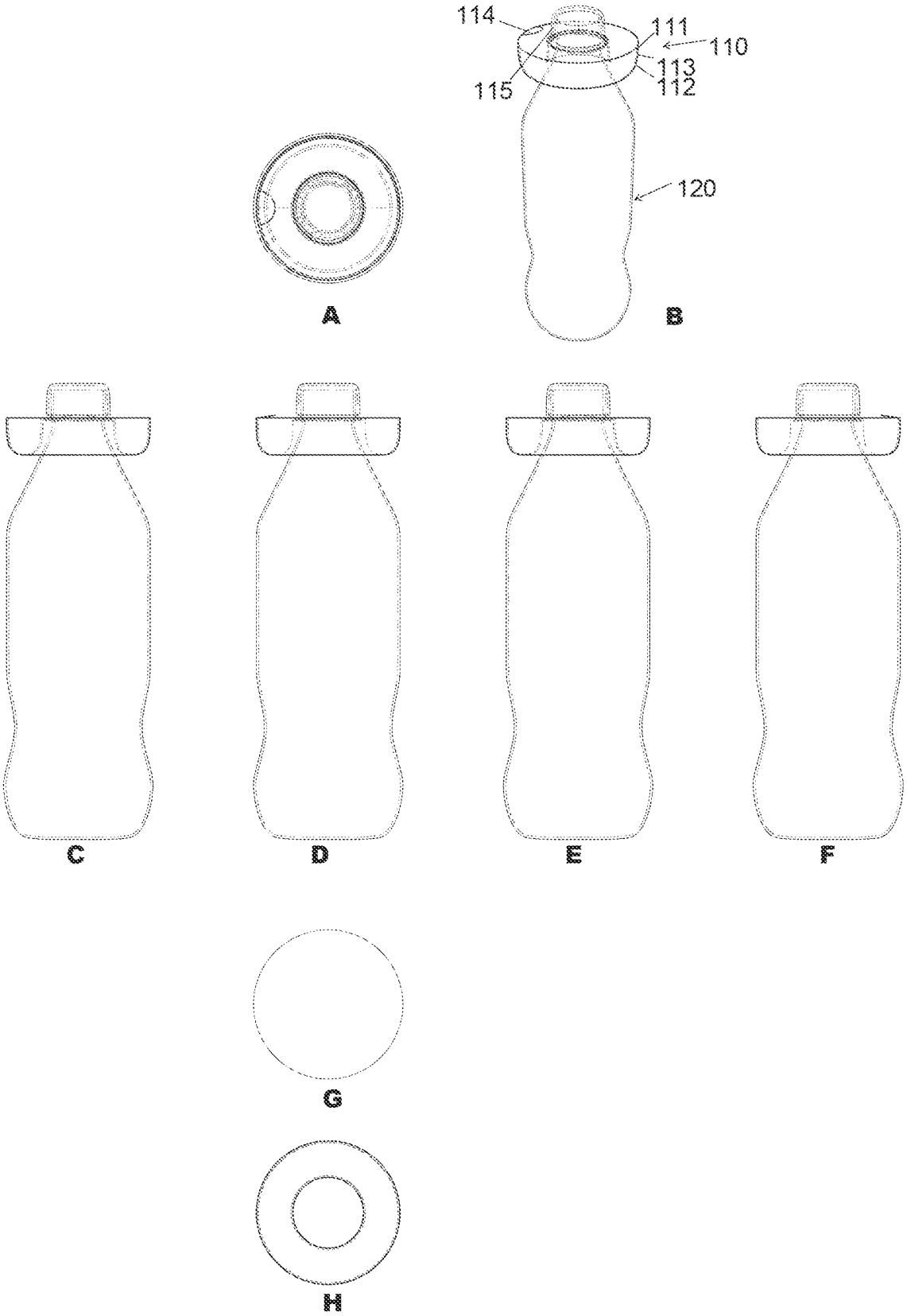
FIGS. 34A, 34B, 34C, 34D, 34E, 34F, 34G, and 34H (collectively "FIG. 34") shows an example container assembly having a beverage bottle and container lid having a donut shape.

FIG. 34 illustrates an example container assembly according to various embodiments of this disclosure. The container assembly may include a beverage bottle and a container lid 110 that may have a substantially "donut" shape. In some embodiments, the container lid 110 may have a coupling structure 115 that extends from the bottom surface of the base portion through the top surface of the top portion of the container lid 110. In such a configuration, the coupling structure 115 may engage with the lower part of the mouth 121 of the beverage bottle. When the container lid 110 is removably mounted to the beverage bottle, the mouth 121 of the beverage bottle protrudes above the top portion of the container lid.

As stated above, the recessed coupling structure 115 may removably engage with the mouth 121 of the beverage or food container 120 by any suitable means, including but not limited to, complementary threading, snap-fit or friction-fit means, bayonet means, or any other suitable mechanism or combination of mechanisms for coupling, as will be appreciated by those skilled in the art.

Also within the scope of this disclosure is a method of providing a beverage, such as fruit juice. The beverage is prepared by mixing the substance, such as dry fruit power, contained in the container lid 110 with a fluent product (e.g., water, milk, vitamins, etc.) in the beverage or food container 120.

In some embodiments, the method may include: providing container assembly described herein; removing the container lid 110 away by disengaging from the beverage or food container 120; unloading the fruit powder from the container lid 110 through the opening; and mixing the fruit powder with the beverage or food contained within the beverage or food container 120.

To aid in understanding the detailed description of the compositions and methods according to the disclosure, a few express definitions are provided to facilitate an unambiguous disclosure of the various aspects of the disclosure. Unless otherwise defined, all technical and scientific terms used herein have the same meaning as commonly understood by one of ordinary skill in the art to which this disclosure belongs.

The term "packaging," as used herein, means a structure or material that is at least partially disposed on or about a consumer product.

The term "fluent product" (or "fluent material"), as used herein, refers to liquid products, gels, slurries, flowable pastes, pourable solid products (including, but not limited to, granular materials, powders, beads, and pods), and/or gaseous products (including, but not limited to those used in aerosols).

The terms "disposed on" or "disposed thereon," as used herein with reference to the containers on container-loaded vehicles, means any of the following: held by, affixed to, or otherwise coupled to in a removable manner. When the containers are described as being disposed on the vehicles, the container(s) can be in any suitable orientation with respect to the vehicles including, but not limited to: on top of the vehicles, underneath the vehicles, adjacent to one or more of the sides of the vehicles, or (if there are more than one container disposed on a vehicle) any combinations thereof.

It is noted here that, as used in this specification and the appended claims, the singular forms "a," "an," and "the" include plural reference unless the context clearly dictates otherwise.

The term "plurality," as used herein, means more than one.

The terms "including," "comprising," "containing," or "having" and variations thereof are meant to encompass the items listed thereafter and equivalents thereof as well as additional subject matter unless otherwise noted.

The phrases "in one embodiment," "in various embodiments," "in some embodiments," and the like are used repeatedly. Such phrases do not necessarily refer to the same embodiment, but they may unless the context dictates otherwise.

The terms "and/or" or "/" means any one of the items, any combination of the items, or all of the items with which this term is associated.

The word "substantially" does not exclude "completely," e.g., a composition which is "substantially free" from Y may be completely free from Y. Where necessary, the word "substantially" may be omitted from the definition of the invention.

As used herein, the term "approximately" or "about," as applied to one or more values of interest, refers to a value that is similar to a stated reference value. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value). Unless indicated otherwise herein, the term "about" is intended to include values, e.g., weight percents, proximate to the recited range that are equivalent in terms of the functionality of the individual ingredient, the composition, or the embodiment.

As disclosed herein, a number of ranges of values are provided. It is understood that each intervening value, to the tenth of the unit of the lower limit, unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither, or both limits are included in the smaller ranges is also encompassed within the invention, subject to any specifically excluded limit in the stated range. Where the stated range includes one or both of the limits, ranges excluding either or both of those included limits are also included in the invention.

As used herein, the term "each," when used in reference to a collection of items, is intended to identify an individual item in the collection but does not necessarily refer to every item in the collection. Exceptions can occur if explicit disclosure or context clearly dictates otherwise.

The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

All methods described herein are performed in any suitable order unless otherwise indicated herein or otherwise clearly contradicted by context. In regard to any of the methods provided, the steps of the method may occur simultaneously or sequentially. When the steps of the method occur sequentially, the steps may occur in any order, unless noted otherwise. In cases in which a method comprises a combination of steps, each and every combination or sub-combination of the steps is encompassed within the scope of the disclosure, unless otherwise noted herein.

Each publication, patent application, patent, and other reference cited herein is incorporated by reference in its entirety to the extent that it is not inconsistent with the present disclosure. Publications disclosed herein are provided solely for their disclosure prior to the filing date of the present invention. Nothing herein is to be construed as an admission that the present invention is not entitled to antedate such publication by virtue of prior invention. Further, the dates of publication provided may be different from the actual publication dates, which may need to be independently confirmed.

It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A container assembly, comprising: a beverage or food container, and a container lid, comprising a top portion, a base portion, and a wall connecting the top portion and the base portion, wherein the container lid comprises a coupling structure adapted to be removably mounted to the beverage or food container, thereby coupling the container lid to a least a portion of the beverage or food container, wherein the top portion, the base portion, and the wall define a compartment adapted to enclose a substance, wherein the container lid further comprises a sealable opening, through which the substance is to be unloaded from the container lid and mixed with beverage or food contained within the beverage or food container, wherein the container lid comprises a spout protruding downwardly from the base portion, the spout adapted to aid unloading and mixing of the substance with the beverage or food contained within the beverage or food container, wherein the spout has an upper portion connecting with a least a portion of the wall or the base portion of the container lid, and a lower portion in contact with an outer surface of the beverage or food container, and wherein a least a portion of the spout and the opening are positioned on the same plane.

2. The container assembly of claim 1, wherein the beverage or food container is a beverage container.

3. The container assembly of claim 1, wherein the container lid contains the sub stance.

4. The container assembly of claim 3, wherein the substance comprises fruit powder.

5. The container assembly of claim 1, wherein the coupling structure is positioned outwardly away from the top portion and the base portion of the container lid.

6. The container assembly of claim 1, wherein the coupling structure is positioned below the base portion of the container lid.

7. The container assembly of claim 1, wherein the coupling structure is positioned above the top portion of the container lid.

8. The container assembly of claim 1, wherein the coupling structure is positioned inwardly towards the top portion of the container lid.

9. The container assembly of claim 1, wherein the coupling structure extends from the base portion or the wall of the container lid and is adapted to engage an outer surface of the beverage or food container.

10. The container assembly of claim 1, wherein the coupling structure encircles the base portion.

11. The container assembly of claim 1, wherein the coupling structure protrudes from a bottom edge of the wall of the container lid.

12. The container assembly of claim 1, wherein the coupling structure has a smaller or larger circumference than the base portion.

13. The container assembly of claim 1, wherein the coupling structure has the same circumference as the base portion.

14. The container assembly of claim 1, wherein the coupling structure comprises screw thread adapted to secure the container lid to the beverage or food container.

15. The container assembly of claim 1, wherein the top portion has a circumference larger or smaller than the base portion.

16. The container assembly of claim 1, wherein the top portion has a cone, sphere, cube, squircle, or round shape.

17. The container assembly of claim 1, wherein the top portion or the base portion has a circular, oval, ellipse, triangular, square, rectangular, or polygonal cross-sectional shape.

18. The container assembly of claim 1, wherein the top portion comprises a surface having a shape adapted to complement a bottom surface of the beverage or food container, such that the container assembly is stackable above or below a second container assembly.

19. The container assembly of claim 1, wherein the opening is positioned at the base portion.

20. The container assembly of claim 1, wherein the opening is positioned at the top portion.

21. The container assembly of claim 1, wherein the container lid comprises a cover adapted to seal the opening.

22. The container assembly of claim 21, wherein the opening is resealable with the cover.

23. The container assembly of claim 1, wherein the container lid or the beverage or food container is formed of a transparent material.

24. The container assembly of claim 1, wherein the container lid comprises a thermoplastic material.

25. The container assembly of claim 1, wherein the beverage or food container further comprises a cover adapted to cover the beverage or food container.

26. The container assembly of claim 25, wherein the beverage or food container is resealable with the cover.

27. The container assembly of claim 1, wherein the beverage or food container is a can or a bottle.

28. A method of providing a beverage, comprising: providing container assembly of claim 1;

removing the container lid away by disengaging from the beverage or food container; unloading fruit powder from the container lid through the opening; and mixing the fruit powder with the beverage or food contained within the beverage or food container.

* * * * *